US009809787B2

(12) United States Patent
Vind et al.

(10) Patent No.: US 9,809,787 B2
(45) Date of Patent: Nov. 7, 2017

(54) DETERGENT COMPOSITIONS COMPRISING LIPASE

(71) Applicant: Novozymes A/S, Bagsvaerd (DK)

(72) Inventors: Jesper Vind, Vaerloese (DK); Lise Munch Mikkelsen, Roedovre (DK); Marco Malten, Copenhagen (DK); Allan Svendsen, Hoersholm (DK); Kim Borch, Birkeroed (DK)

(73) Assignee: NOVOZYMES A/S, Bagsvaerd (DK)

( * ) Notice: Subject to any disclaimer, the term of this patent is extended or adjusted under 35 U.S.C. 154(b) by 15 days.

(21) Appl. No.: 14/365,866

(22) PCT Filed: Dec. 20, 2012

(86) PCT No.: PCT/EP2012/076468

§ 371 (c)(1),
(2) Date: Jun. 16, 2014

(87) PCT Pub. No.: WO2013/098205

PCT Pub. Date: Jul. 4, 2013

(65) Prior Publication Data

US 2014/0323382 A1 Oct. 30, 2014

Related U.S. Application Data

(60) Provisional application No. 61/582,534, filed on Jan. 3, 2012.

(30) Foreign Application Priority Data

Dec. 29, 2011 (EP) ..... 11196000

(51) Int. Cl.

| | |
|---|---|
| ***C11D 1/02*** | (2006.01) |
| ***C11D 3/386*** | (2006.01) |
| *C11D 1/14* | (2006.01) |
| *C11D 1/22* | (2006.01) |

(52) U.S. Cl.

CPC ..... *C11D 3/38627* (2013.01); *C11D 1/02* (2013.01); *C11D 1/14* (2013.01); *C11D 1/22* (2013.01)

(58) Field of Classification Search

None

See application file for complete search history.

(56) References Cited

U.S. PATENT DOCUMENTS

| | | | | |
|---|---|---|---|---|
| 5,658,871 | A * | 8/1997 | Batenburg | C11D 3/38627 435/196 |
| 5,869,438 | A | 2/1999 | Svendsen | |
| 5,892,013 | A | 4/1999 | Svendsen | |
| 2010/0034797 | A1 | 2/2010 | Svendsen | |

FOREIGN PATENT DOCUMENTS

| | | | |
|---|---|---|---|
| WO | 92/05249 | A1 | 4/1992 |
| WO | 95/22615 | A1 | 8/1995 |
| WO | 2006/136159 | A2 | 12/2006 |
| WO | 2007/087319 | A2 | 8/2007 |
| WO | 2008/079685 | A2 | 7/2008 |
| WO | WO2008079685 | * | 7/2008 |
| WO | 2009/106553 | A2 | 9/2009 |

OTHER PUBLICATIONS

Sigma-Aldrich, Sodium dodecyl sulfate. Downloaded Sep. 28, 2016.*

Hofman et al, Bile salts as biological surfactants. Colloids and Surfaces vol. 30, Issue 1, 1987, pp. 145-173.*

* cited by examiner

*Primary Examiner* — Sheridan Swope

(74) *Attorney, Agent, or Firm* — Todd Sladek

(57) ABSTRACT

The present invention relates a method of obtaining a detergent composition comprising introducing (a) a lipase variant of a parent lipase which variant has at least 60% sequence identity with SEQ ID NO: 2, a substitution at a position corresponding to D254 of the mature polypeptide of SEQ ID NO: 2 and has lipase activity and (b) an anionic surfactant, wherein said composition has increased stability in comparison with a corresponding composition comprising the parent lipase.

5 Claims, No Drawings

DETERGENT COMPOSITIONS COMPRISING LIPASE

CROSS-REFERENCE TO RELATED APPLICATIONS

This application is a 35 U.S.C. 371 national application of PCT/EP2012/076468 filed Dec. 20, 2012 which claims priority or the benefit under 35 U.S.C. 119 of European application no. 11196000.1 filed Dec. 29, 2011 and U.S. provisional application no. 61/582,534 filed Jan. 3, 2012, the contents of which are fully incorporated herein by reference.

REFERENCE TO A SEQUENCE LISTING

This application contains a Sequence Listing in computer readable form, which is incorporated herein by reference.

BACKGROUND OF THE INVENTION

Field of the Invention

The present invention relates to detergent compositions and methods of obtaining them.

Description of the Related Art

Detergent compositions are continuously developed to optimize and improve their cleaning efficiency. They are based on a complex mixture of various ingredients amongst which surfactants and enzymes are encompassed. However, lipases are in general unstable in the presence of anionic surfactants thereby affecting the stability of the composition. It would thus be desirable to obtain detergent compositions with improved stability comprising both anionic surfactants as well as lipases.

WO92/05249 relates to lipase variants of *Thermomyces lanuginosus* with improved properties. Although the document describes that variants may comprise a substitution at amino acid position D254, it does not show nor does it indicate that this particular position is important for obtaining a stable variant that may be used for providing stabilized detergent compositions comprising anionic surfactants.

SUMMARY OF THE INVENTION

The present invention relates to a method of obtaining a detergent composition comprising introducing (a) a lipase variant of a parent lipase which variant has at least 60% sequence identity with SEQ ID NO: 2, a substitution at a position corresponding to D254 of the mature polypeptide of SEQ ID NO: 2 and has lipase activity and (b) an anionic surfactant, wherein said composition has increased stability in comparison with a corresponding composition comprising the parent lipase.

DEFINITIONS

Lipase: The term "lipase" or "lipolytic enzyme" or "lipid esterase" is an enzyme in class EC 3.1,1 as defined by Enzyme Nomenclature. It may have lipase activity (triacylglycerol lipase, EC 3.1.1.3), cutinase activity (EC 3.1.1.74), sterol esterase activity (EC 3.1.1.13) and/or wax-ester hydrolase activity (EC 3.1.1.50). For purposes of the present invention, lipase activity is determined according to the procedure described in the Examples. In one aspect, the variants of the present invention have at least 20%, e.g., at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or at least 100% of the lipase activity of the mature polypeptide of SEQ ID NO: 2.

Allelic variant: The term "allelic variant" means any of two or more alternative forms of a gene occupying the same chromosomal locus. Allelic variation arises naturally through mutation, and may result in polymorphism within populations. Gene mutations can be silent (no change in the encoded polypeptide) or may encode polypeptides having altered amino acid sequences. An allelic variant of a polypeptide is a polypeptide encoded by an allelic variant of a gene.

cDNA: The term "cDNA" means a DNA molecule that can be prepared by reverse transcription from a mature, spliced, mRNA molecule obtained from a eukaryotic or prokaryotic cell. cDNA lacks intron sequences that may be present in the corresponding genomic DNA. The initial, primary RNA transcript is a precursor to mRNA that is processed through a series of steps, including splicing, before appearing as mature spliced mRNA.

Coding sequence: The term "coding sequence" means a polynucleotide, which directly specifies the amino acid sequence of a variant. The boundaries of the coding sequence are generally determined by an open reading frame, which begins with a start codon such as ATG, GTG or TTG and ends with a stop codon such as TAA, TAG, or TGA. The coding sequence may be a genomic DNA, cDNA, synthetic DNA, or a combination thereof.

Control sequences: The term "control sequences" means nucleic acid sequences necessary for expression of a polynucleotide encoding a variant of the present invention. Each control sequence may be native (i.e., from the same gene) or foreign (i.e., from a different gene) to the polynucleotide encoding the variant or native or foreign to each other. Such control sequences include, but are not limited to, a leader, polyadenylation sequence, propeptide sequence, promoter, signal peptide sequence, and transcription terminator. At a minimum, the control sequences include a promoter, and transcriptional and translational stop signals. The control sequences may be provided with linkers for the purpose of introducing specific restriction sites facilitating ligation of the control sequences with the coding region of the polynucleotide encoding a variant.

Expression: The term "expression" includes any step involved in the production of a variant including, but not limited to, transcription, post-transcriptional modification, translation, post-translational modification, and secretion.

Expression vector: The term "expression vector" means a linear or circular DNA molecule that comprises a polynucleotide encoding a variant and is operably linked to control sequences that provide for its expression.

Fragment: The term "fragment" means a polypeptide having one or more (e.g., several) amino acids absent from the amino and/or carboxyl terminus of a mature polypeptide; wherein the fragment has lipase activity. In one aspect, a fragment contains at least 50%, at least 55%, at least 60%, at least 65%, at least 70%, at least 75%, at least 80%, at least 85%, at least 90%, and at least 95% of the number of amino acids of the mature polypeptide.

High stringency conditions: The term "high stringency conditions" means for probes of at least 100 nucleotides in length, prehybridization and hybridization at 42° C. in 5×SSPE, 0.3% SDS, 200 micrograms/ml sheared and denatured salmon sperm DNA, and 50% formamide, following standard Southern blotting procedures for 12 to 24 hours. The carrier material is finally washed three times each for 15 minutes using 2×SSC, 0.2% SDS at 65° C.

Host cell: The term "host cell" means any cell type that is susceptible to transformation, transfection, transduction, or the like with a nucleic acid construct or expression vector comprising a polynucleotide of the present invention. The term "host cell" encompasses any progeny of a parent cell that is not identical to the parent cell due to mutations that occur during replication.

Improved property: The term "improved property" means a characteristic associated with a variant that is improved compared to the parent. Such improved properties include, but are not limited to, chemical stability, oxidation stability, pH stability, stability under storage conditions, stability towards surfactants and surfactant micelles, and thermostability.

Isolated: The term "isolated" means a substance in a form or environment which does not occur in nature. Non-limiting examples of isolated substances include (1) any non-naturally occurring substance, (2) any substance including, but not limited to, any enzyme, variant, nucleic acid, protein, peptide or cofactor, that is at least partially removed from one or more or all of the naturally occurring constituents with which it is associated in nature; (3) any substance modified by the hand of man relative to that substance found in nature; or (4) any substance modified by increasing the amount of the substance relative to other components with which it is naturally associated (e.g., multiple copies of a gene encoding the substance; use of a stronger promoter than the promoter naturally associated with the gene encoding the substance). An isolated substance may be present in a fermentation broth sample.

Low stringency conditions: The term "low stringency conditions" means for probes of at least 100 nucleotides in length, prehybridization and hybridization at 42° C. in 5×SSPE, 0.3% SDS, 200 micrograms/ml sheared and denatured salmon sperm DNA, and 25% formamide, following standard Southern blotting procedures for 12 to 24 hours. The carrier material is finally washed three times each for 15 minutes using 2×SSC, 0.2% SDS at 50° C.

Mature polypeptide: The term "mature polypeptide" means a polypeptide in its final form following translation and any post-translational modifications, such as N-terminal processing, C-terminal truncation, glycosylation, phosphorylation, etc. In one aspect, the mature polypeptide is amino acids 1 to 269 of SEQ ID NO: 2

Mature polypeptide coding sequence: The term "mature polypeptide coding sequence" means a polynucleotide that encodes a mature polypeptide having lipase activity. In one aspect, the mature polypeptide coding sequence is nucleotides 67 to 873 of SEQ ID NO: 1.

Medium stringency conditions: The term "medium stringency conditions" means for probes of at least 100 nucleotides in length, prehybridization and hybridization at 42° C. in 5×SSPE, 0.3% SDS, 200 micrograms/ml sheared and denatured salmon sperm DNA, and 35% formamide, following standard Southern blotting procedures for 12 to 24 hours. The carrier material is finally washed three times each for 15 minutes using 2×SSC, 0.2% SDS at 55° C.

Medium-high stringency conditions: The term "medium-high stringency conditions" means for probes of at least 100 nucleotides in length, prehybridization and hybridization at 42° C. in 5×SSPE, 0.3% SDS, 200 micrograms/ml sheared and denatured salmon sperm DNA, and either 35% formamide, following standard Southern blotting procedures for 12 to 24 hours. The carrier material is finally washed three times each for 15 minutes using 2×SSC, 0.2% SDS at 60° C.

Mutant: The term "mutant" means a polynucleotide encoding a variant.

Nucleic acid construct: The term "nucleic acid construct" means a nucleic acid molecule, either single- or double-stranded, which is isolated from a naturally occurring gene or is modified to contain segments of nucleic acids in a manner that would not otherwise exist in nature or which is synthetic, which comprises one or more control sequences.

Operably linked: The term "operably linked" means a configuration in which a control sequence is placed at an appropriate position relative to the coding sequence of a polynucleotide such that the control sequence directs expression of the coding sequence.

Parent or parent lipase: The term "parent" or "parent lipase" means a lipase to which an substitution is made to produce the enzyme variants of the present invention. The parent may be a naturally occurring (wild-type) polypeptide or a variant or fragment thereof.

Sequence identity: The relatedness between two amino acid sequences or between two nucleotide sequences is described by the parameter "sequence identity".

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the -nobrief option) is used as the percent identity and is calculated as follows:

(Identical Residues×100)/(Length of Alignment−Total Number of Gaps in Alignment)

For purposes of the present invention, the sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 5.0.0 or later. The parameters used are gap open penalty of 10, gap extension penalty of 0.5, and the EDNAFULL (EMBOSS version of NCBI NUC4.4) substitution matrix. The output of Needle labeled "longest identity" (obtained using the -nobrief option) is used as the percent identity and is calculated as follows:

(Identical Deoxyribonucleotides×100)/(Length of Alignment−Total Number of Gaps in Alignment)

Subsequence: The term "subsequence" means a polynucleotide having one or more (e.g., several) nucleotides absent from the 5' and/or 3' end of a mature polypeptide coding sequence; wherein the subsequence encodes a fragment having lipase activity. In one aspect, a subsequence contains at least 50%, at least 55%, at least 60%, at least 65%, at least 70%, at least 75%, at least 80%, at least 85%, at least 90%, and at least 95% of the number of nucleotides encoding the mature polypeptide.

Variant: The term "variant" means a polypeptide having lipase activity comprising a substitution at one or more (e.g., several) positions. A substitution means replacement of the amino acid occupying a position with a different amino acid. The variants of the present invention have at least 20%, e.g., at least 40%, at least 50%, at least 60%, at least 70%, at least 80%, at least 90%, at least 95%, or at least 100% of the lipase activity of the mature polypeptide of SEQ ID NO: 2.

Very high stringency conditions: The term "very high stringency conditions" means for probes of at least 100 nucleotides in length, prehybridization and hybridization at 42° C. in 5×SSPE, 0.3% SDS, 200 micrograms/ml sheared and denatured salmon sperm DNA, and 50% formamide, following standard Southern blotting procedures for 12 to 24 hours. The carrier material is finally washed three times each for 15 minutes using 2×SSC, 0.2% SDS at 70° C.

Very low stringency conditions: The term "very low stringency conditions" means for probes of at least 100 nucleotides in length, prehybridization and hybridization at 42° C. in 5×SSPE, 0.3% SDS, 200 micrograms/ml sheared and denatured salmon sperm DNA, and 25% formamide, following standard Southern blotting procedures for 12 to 24 hours. The carrier material is finally washed three times each for 15 minutes using 2×SSC, 0.2% SDS at 45° C.

Wild-type lipase: The term "wild-type" lipase means a lipase expressed by a naturally occurring microorganism, such as a bacterium, yeast, or filamentous fungus found in nature.

Conventions for Designation of Variants

For purposes of the present invention, the mature polypeptide disclosed in SEQ ID NO: 2 is used to determine the corresponding amino acid residue in another lipase. The amino acid sequence of another lipase is aligned with the mature polypeptide disclosed in SEQ ID NO: 2, and based on the alignment, the amino acid position number corresponding to any amino acid residue in the mature polypeptide disclosed in SEQ ID NO: 2 is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix.

Identification of the corresponding amino acid residue in another lipase can be determined by an alignment of multiple polypeptide sequences using several computer programs including, but not limited to, MUSCLE (multiple sequence comparison by log-expectation; version 3.5 or later; Edgar, 2004, *Nucleic Acids Research* 32: 1792-1797), MAFFT (version 6.857 or later; Katoh and Kuma, 2002, *Nucleic Acids Research* 30: 3059-3066; Katoh et al., 2005, *Nucleic Acids Research* 33: 511-518; Katoh and Toh, 2007, *Bioinformatics* 23: 372-374; Katoh et al., 2009, *Methods in Molecular Biology* 537: 39-64; Katoh and Toh, 2010, *Bioinformatics* 26: 1899-1900), and EMBOSS EMMA employing ClustalW (1.83 or later; Thompson et al., 1994, *Nucleic Acids Research* 22: 4673-4680), using their respective default parameters.

When the other enzyme has diverged from the mature polypeptide of SEQ ID NO: 2 such that traditional sequence-based comparison fails to detect their relationship (Lindahl and Elofsson, 2000, *J. Mol. Biol.* 295: 613-615), other pairwise sequence comparison algorithms can be used. Greater sensitivity in sequence-based searching can be attained using search programs that utilize probabilistic representations of polypeptide families (profiles) to search databases. For example, the PSI-BLAST program generates profiles through an iterative database search process and is capable of detecting remote homologs (Atschul et al., 1997, *Nucleic Acids Res.* 25: 3389-3402). Even greater sensitivity can be achieved if the family or superfamily for the polypeptide has one or more representatives in the protein structure databases. Programs such as GenTHREADER (Jones, 1999, *J. Mol. Biol.* 287: 797-815; McGuffin and Jones, 2003, *Bioinformatics* 19: 874-881) utilize information from a variety of sources (PSI-BLAST, secondary structure prediction, structural alignment profiles, and solvation potentials) as input to a neural network that predicts the structural fold for a query sequence. Similarly, the method of Gough et al., 2000, *J. Mol. Biol.* 313: 903-919, can be used to align a sequence of unknown structure with the superfamily models present in the SCOP database. These alignments can in turn be used to generate homology models for the polypeptide, and such models can be assessed for accuracy using a variety of tools developed for that purpose.

For proteins of known structure, several tools and resources are available for retrieving and generating structural alignments. For example the SCOP superfamilies of proteins have been structurally aligned, and those alignments are accessible and downloadable. Two or more protein structures can be aligned using a variety of algorithms such as the distance alignment matrix (Holm and Sander, 1998, *Proteins* 33: 88-96) or combinatorial extension (Shindyalov and Bourne, 1998, *Protein Engineering* 11: 739-747), and implementation of these algorithms can additionally be utilized to query structure databases with a structure of interest in order to discover possible structural homologs (e.g., Holm and Park, 2000, *Bioinformatics* 16: 566-567).

In describing the variants of the present invention, the nomenclature described below is adapted for ease of reference. The accepted IUPAC single letter or three letter amino acid abbreviation is employed.

Substitutions. For an amino acid substitution, the following nomenclature is used: Original amino acid, position, substituted amino acid. Accordingly, the substitution of threonine at position 226 with alanine is designated as "Thr226Ala" or "T226A". Multiple mutations are separated by addition marks ("+"), e.g., "Gly205Arg+Ser411Phe" or "G205R+S411F", representing substitutions at positions 205 and 411 of glycine (G) with arginine (R) and serine (S) with phenylalanine (F), respectively.

Multiple Substitutions. Variants comprising multiple substitutions are separated by addition marks ("+"), e.g., "Arg170Tyr+Gly195Glu" or "R170Y+G195E" representing a substitution of arginine and glycine at positions 170 and 195 with tyrosine and glutamic acid, respectively.

Different Substitutions. Where different substitutions can be introduced at a position, the different substitutions are separated by a comma, e.g., "Arg170Tyr,Glu" represents a substitution of arginine at position 170 with tyrosine or glutamic acid. Thus, "Tyr167Gly,Ala+Arg170Gly,Ala" designates the following variants: "Tyr167Gly+Arg170Gly", "Tyr167Gly+Arg170Ala", "Tyr167Ala+Arg170Gly", and "Tyr167Ala+Arg170Ala".

DETAILED DESCRIPTION OF THE INVENTION

The present invention relates to use of a lipase variant derived from a parent lipase with at least 60% sequence identity with SEQ ID NO: 2, which variant has lipase activity and in comparison with the parent lipase comprises a substitution at a position corresponding to D254 of the mature polypeptide of SEQ ID NO: 2, for obtaining a detergent composition comprising at least one anionic surfactant which composition is more stable in comparison with a corresponding composition comprising the parent lipase.

The present invention furthermore provides detergent compositions and methods of obtaining them.

Variants

In one embodiment the variant is a lipase variant derived from a parent lipase with at least 60% sequence identity with SEQ ID NO: 2, which variant has lipase activity and in comparison with the parent lipase comprises a substitution at a position corresponding to D254 of the mature polypeptide of SEQ ID NO: 2 and is more stable in comparison with the parent lipase in the presence of anionic surfactants.

In an embodiment, the variant has sequence identity of at least 60%, e.g., at least 65%, at least 70%, at least 75%, at least 80%, at least 85%, at least 90%, at least 91%, at least 92%, at least 93%, at least 94%, at least 95%, at least 96%, at least 97%, at least 98%, or at least 99%, but less than 100%, to the amino acid sequence of the parent lipase.

In another embodiment, the variant has at least 60%, e.g., at least 65%, at least 70%, at least 75%, at least 80%, at least 85%, at least 90%, at least 91%, at least 92%, at least 93%, at least 94%, at least 95%, such as at least 96%, at least 97%, at least 98%, or at least 99%, but less than 100%, sequence identity to the mature polypeptide of SEQ ID NO: 2.

In one aspect, the number of substitutions in the variants of the present invention is 1-20, e.g., 1-10 and 1-5, such as 1, 2, 3, 4, 5, 6, 7, 8, 9, 10, 11, 12, 13, 14, 15, 16, 17, 18, 19, or 20 substitutions.

In another aspect, a variant comprises a substitution at position corresponding to 254 of the mature polypeptide of SEQ ID NO: 2. In another aspect, a variant comprises a substitution at two positions corresponding to position 254 and any of positions 33, 231, and 233. In another aspect, a variant comprises a substitution at three positions corresponding to 254 and any of positions 33, 231, and 233. In another aspect, a variant comprises a substitution at each position corresponding to positions 22, 231, 233 and 254.

In another aspect, the variant comprises or consists of a substitution at a position corresponding to position 254. In another aspect, the amino acid at a position corresponding to position 254 is substituted with Ala, Arg, Asn, Asp, Cys, Gln, Glu, Gly, His, Ile, Leu, Lys, Met, Phe, Pro, Ser, Thr, Trp, Tyr, or Val. In another aspect, the variant comprises or consists of the substitution D254S,T,N,Y,H,L,Q of the mature polypeptide of SEQ ID NO: 2.

In another aspect, the variant further comprises or consists of a substitution at a position corresponding to position 33. In another aspect, the amino acid at a position corresponding to position 33 is substituted with Ala, Arg, Asn, Asp, Cys, Gln, Glu, Gly, His, Ile, Leu, Lys, Met, Phe, Pro, Ser, Thr, Trp, Tyr, or Val. In another aspect, the variant comprises of the substitution N33Q of the mature polypeptide of SEQ ID NO: 2.

In another aspect, the variant further comprises or consists of a substitution at a position corresponding to position 231. In another aspect, the amino acid at a position corresponding to position 231 is substituted with Ala, Arg, Asn, Asp, Cys, Gln, Glu, Gly, His, Ile, Leu, Lys, Met, Phe, Pro, Ser, Thr, Trp, Tyr, or Val. In another aspect, the variant comprises of the substitution T231R of the mature polypeptide of SEQ ID NO: 2.

In another aspect, the variant further comprises or consists of a substitution at a position corresponding to position 233. In another aspect, the amino acid at a position corresponding to position 233 is substituted with Ala, Arg, Asn, Asp, Cys, Gln, Glu, Gly, His, Ile, Leu, Lys, Met, Phe, Pro, Ser, Thr, Trp, Tyr, or Val. In another aspect, the variant comprises of the substitution N233R of the mature polypeptide of SEQ ID NO: 2.

In another aspect, the variant comprises or consists of substitutions at positions corresponding to positions D254S, T,N,Y,H,L,Q and N33Q, such as those described above.

In another aspect, the variant comprises or consists of substitutions at positions corresponding to positions D254S, T,N,Y,H,L,Q and T231R, such as those described above.

In another aspect, the variant comprises or consists of substitutions at positions corresponding to positions D254S, T,N,Y,H,L,Q and N233R, such as those described above.

In another aspect, the variant comprises or consists of substitutions at positions corresponding to positions D254S, T,N,Y,H,L,Q, N33Q and T231R, such as those described above.

In another aspect, the variant comprises or consists of substitutions at positions corresponding to positions D254S, T,N,Y,H,L,Q, N33Q and N233R, such as those described above.

In another aspect, the variant comprises or consists of substitutions at positions corresponding to positions D254S, T,N,Y,H,L,Q, N33Q, T231R and N233R, such as those described above.

The variants may further comprise one or more additional substitutions at one or more (e.g., several) other positions.

In another aspect, the variant comprises or contains substitutions selected from: T231R+D254S; N233R+D254S; T231R+N233R+D254S; N33Q+D254S; N33Q+T231R+D254S; N33Q+N233R+D254S; N33Q+T231R+N233R+D254S; T231R+D254T; N233R+D254T; T231R+N233R+D254T; N33Q+D254T; N33Q+T231R+D254T; N33Q+N233R+D254T; N33Q+T231R+N233R+D254T; T231R+D254N; N233R+D254N; T231R+N233R+D254N; N33Q+D254N; N33Q+T231R+D254N; N33Q+N233R+D254N; N33Q+T231R+N233R+D254N; T231R+D254Y; N233R+D254Y; T231R+N233R+D254Y; N33Q+D254Y; N33Q+T231R+D254Y; N33Q+N233R+D254Y; N33Q+T231R+N233R+D254Y; T231R+D254H; N233R+D254H; T231R+N233R+D254H; N33Q+D254H; N33Q+T231R+D254H; N33Q+N233R+D254H; N33Q+T231R+N233R+D254H; T231R+D254L; N233R+D254L; T231R+N233R+D254L; N33Q+D254L; N33Q+T231R+D254L; N33Q+N233R+D254L; N33Q+T231R+N233R+D254L; T231R+D254Q; N233R+D254Q; T231R+N233R+D254Q; N33Q+D254Q; N33Q+T231R+D254Q; N33Q+N233R+D254Q; or N33Q+T231R+N233R+D254Q.

The amino acid changes may be of a minor nature, that is conservative amino acid substitutions or insertions that do not significantly affect the folding and/or activity of the protein; small deletions, typically of 1-30 amino acids; small amino- or carboxyl-terminal extensions, such as an amino-terminal methionine residue; a small linker peptide of up to 20-25 residues; or a small extension that facilitates purification by changing net charge or another function, such as a poly-histidine tract, an antigenic epitope or a binding domain.

Examples of conservative substitutions are within the groups of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, *In, The Proteins*, Academic Press, New York. Common substitutions are Ala/Ser, Val/Ile, Asp/Glu, Thr/Ser, Ala/Gly, Ala/Thr, Ser/

Asn, Ala/Val, Ser/Gly, Tyr/Phe, Ala/Pro, Lys/Arg, Asp/Asn, Leu/Ile, Leu/Val, Ala/Glu, and Asp/Gly.

Alternatively, the amino acid changes are of such a nature that the physico-chemical properties of the polypeptides are altered. For example, amino acid changes may improve the thermal stability of the polypeptide, alter the substrate specificity, change the pH optimum, and the like.

Essential amino acids in a polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for lipase activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identity of essential amino acids can also be inferred from an alignment with a related polypeptide.

The variants may consist of 150 to 450 amino acids, e.g., 200 to 400, 250 to 350, and about 300 amino acids.

In an embodiment, the variant has improved chemical stability compared to the parent enzyme.

In an embodiment, the variant has improved oxidation stability compared to the parent enzyme.

In an embodiment, the variant has improved pH stability compared to the parent enzyme.

In an embodiment, the variant has improved stability under storage conditions compared to the parent enzyme.

In an embodiment, the variant has improved stability towards surfactants compared to the parent enzyme.

In an embodiment, the variant has improved substrate stability compared to the parent enzyme.

In an embodiment, the variant has improved thermo stability compared to the parent enzyme.

Parent Lipases

The parent lipase may be (a) a polypeptide having at least 60% sequence identity to the mature polypeptide of SEQ ID NO: 2; (b) a polypeptide encoded by a polynucleotide that hybridizes under low stringency conditions with (i) the mature polypeptide coding sequence of SEQ ID NO: 1, or (ii) the full-length complement of (i); or (c) a polypeptide encoded by a polynucleotide having at least 60% sequence identity to the mature polypeptide coding sequence of SEQ ID NO: 1.

In an aspect, the parent has a sequence identity to the mature polypeptide of SEQ ID NO: 2 of at least 60%, e.g., at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100%, which have lipase activity. In one aspect, the amino acid sequence of the parent differs by no more than 10 amino acids, e.g., 1, 2, 3, 4, 5, 6, 7, 8, or 9, from the mature polypeptide of SEQ ID NO: 2.

In another aspect, the parent comprises or consists of the amino acid sequence of SEQ ID NO: 2. In another aspect, the parent comprises or consists of the mature polypeptide of SEQ ID NO: 2. In another aspect, the parent comprises or consists of amino acids 1 to 269 of SEQ ID NO: 2.

In another aspect, the parent is a fragment contains at least 50%, at least 55%, at least 60%, at least 65%, at least 70%, at least 75%, at least 80%, at least 85%, at least 90%, or at least 95% of the number of amino acids of the mature polypeptide of SEQ ID NO: 2.

In another embodiment, the parent is an allelic variant of the mature polypeptide of SEQ ID NO: 2.

In another aspect, the parent is encoded by a polynucleotide that hybridizes under very low stringency conditions, low stringency conditions, medium stringency conditions, medium-high stringency conditions, high stringency conditions, or very high stringency conditions with (i) the mature polypeptide coding sequence of SEQ ID NO: 1, or (ii) the full-length complement of (i) or (ii) (Sambrook et al., 1989, *Molecular Cloning, A Laboratory Manual,* 2d edition, Cold Spring Harbor, New York).

The polynucleotide of SEQ ID NO: 1 or a subsequence thereof, as well as the polypeptide of SEQ ID NO: 2 or a fragment thereof, may be used to design nucleic acid probes to identify and clone DNA encoding a parent from strains of different genera or species according to methods well known in the art. In particular, such probes can be used for hybridization with the genomic DNA or cDNA of a cell of interest, following standard Southern blotting procedures, in order to identify and isolate the corresponding gene therein. Such probes can be considerably shorter than the entire sequence, but should be at least 15, e.g., at least 25, at least 35, or at least 70 nucleotides in length. Preferably, the nucleic acid probe is at least 100 nucleotides in length, e.g., at least 200 nucleotides, at least 300 nucleotides, at least 400 nucleotides, at least 500 nucleotides, at least 600 nucleotides, at least 700 nucleotides, at least 800 nucleotides, or at least 900 nucleotides in length. Both DNA and RNA probes can be used. The probes are typically labeled for detecting the corresponding gene (for example, with $^{32}P$, $^{3}H$, $^{35}S$, biotin, or avidin). Such probes are encompassed by the present invention.

A genomic DNA or cDNA library prepared from such other strains may be screened for DNA that hybridizes with the probes described above and encodes a parent. Genomic or other DNA from such other strains may be separated by agarose or polyacrylamide gel electrophoresis, or other separation techniques. DNA from the libraries or the separated DNA may be transferred to and immobilized on nitrocellulose or other suitable carrier material. In order to identify a clone or DNA that hybridizes with SEQ ID NO: 1 or a subsequence thereof, the carrier material is used in a Southern blot.

For purposes of the present invention, hybridization indicates that the polynucleotide hybridizes to a labeled nucleic acid probe corresponding to (i) SEQ ID NO: 1; (ii) the mature polypeptide coding sequence of SEQ ID NO: 1; (iii) the full-length complement thereof; or (iv) a subsequence thereof; under very low to very high stringency conditions. Molecules to which the nucleic acid probe hybridizes under these conditions can be detected using, for example, X-ray film or any other detection means known in the art.

In one aspect, the nucleic acid probe is the mature polypeptide coding sequence of SEQ ID NO: 1. In another aspect, the nucleic acid probe is nucleotides 67 to 873 of SEQ ID NO: 1. In another aspect, the nucleic acid probe is a polynucleotide that encodes the polypeptide of SEQ ID NO: 2; the mature polypeptide thereof; or a fragment thereof. In another aspect, the nucleic acid probe is SEQ ID NO: 1.

In another embodiment, the parent is encoded by a polynucleotide having a sequence identity to the mature polypeptide coding sequence of SEQ ID NO: 1 of at least 60%, e.g., at least 65%, at least 70%, at least 75%, at least 80%, at least 85%, at least 90%, at least 91%, at least 92%, at least 93%, at least 94%, at least 95%, at least 96%, at least 97%, at least 98%, at least 99%, or 100%.

The polypeptide may be a hybrid polypeptide in which a region of one polypeptide is fused at the N-terminus or the C-terminus of a region of another polypeptide.

The parent may be a fusion polypeptide or cleavable fusion polypeptide in which another polypeptide is fused at the N-terminus or the C-terminus of the polypeptide of the present invention. A fusion polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fusion polypeptide is under control of the same promoter(s) and terminator. Fusion polypeptides may also be constructed using intein technology in which fusion polypeptides are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, *Proteins: Structure, Function, and Genetics* 6: 240-248; and Stevens, 2003, *Drug Discovery World* 4: 35-48.

The parent may be obtained from microorganisms of any genus. For purposes of the present invention, the term "obtained from" as used herein in connection with a given source shall mean that the parent encoded by a polynucleotide is produced by the source or by a strain in which the polynucleotide from the source has been inserted. In one aspect, the parent is secreted extracellularly.

The parent may be a bacterial lipase. For example, the parent may be a Gram-positive bacterial polypeptide such as a *Bacillus, Clostridium, Enterococcus, Geobacillus, Lactobacillus, Lactococcus, Oceanobacillus, Staphylococcus, Streptococcus*, or *Streptomyces* lipase, or a Gram-negative bacterial polypeptide such as a *Campylobacter, E. coli, Flavobacterium, Fusobacterium, Helicobacter, Ilyobacter, Neisseria, Pseudomonas, Salmonella*, or *Ureaplasma* lipase.

In one aspect, the parent is a *Bacillus alkalophilus, Bacillus amyloliquefaciens, Bacillus brevis, Bacillus circulans, Bacillus clausii, Bacillus coagulans, Bacillus firmus, Bacillus lautus, Bacillus lentus, Bacillus licheniformis, Bacillus megaterium, Bacillus pumilus, Bacillus stearothermophilus, Bacillus subtilis*, or *Bacillus thuringiensis* lipase.

In another aspect, the parent is a *Streptococcus equisimilis, Streptococcus pyogenes, Streptococcus uberis*, or *Streptococcus equi* subsp. *Zooepidemicus* lipase.

In another aspect, the parent is a *Streptomyces achromogenes, Streptomyces avermitilis, Streptomyces coelicolor, Streptomyces griseus*, or *Streptomyces lividans* lipase.

The parent may be a fungal lipase. For example, the parent may be a yeast lipase such as a *Candida, Kluyveromyces, Pichia, Saccharomyces, Schizosaccharomyces*, or *Yarrowia* lipase; or a filamentous fungal lipase such as an *Acremonium, Agaricus, Alternaria, Aspergillus, Aureobasidium, Botryospaeria, Ceriporiopsis, Chaetomidium, Chrysosporium, Claviceps, Cochliobolus, Coprinopsis, Coptotermes, Corynascus, Cryphonectria, Cryptococcus, Diplodia, Exidia, Filibasidium, Fusarium, Gibberella, Holomastigotoides, Humicola, Irpex, Lentinula, Leptospaeria, Magnaporthe, Melanocarpus, Meripilus, Mucor, Myceliophthora, Neocallimastix, Neurospora, Paecilomyces, Penicillium, Phanerochaete, Piromyces, Poitrasia, Pseudoplectania, Pseudotrichonympha, Rhizomucor, Schizophyllum, Scytalidium, Talaromyces, Thermoascus, Thielavia, Tolypocladium, Trichoderma, Trichophaea, Verticillium, Volvariella*, or *Xylaria* lipase.

In another aspect, the parent is a *Saccharomyces carlsbergensis, Saccharomyces cerevisiae, Saccharomyces diastaticus, Saccharomyces douglasii, Saccharomyces kluyveri, Saccharomyces norbensis*, or *Saccharomyces oviformis* lipase.

In another aspect, the parent is an *Acremonium cellulolyticus, Aspergillus aculeatus, Aspergillus awamori, Aspergillus foetidus, Aspergillus fumigatus, Aspergillus japonicus, Aspergillus nidulans, Aspergillus niger, Aspergillus oryzae, Chrysosporium inops, Chrysosporium keratinophilum, Chrysosporium lucknowense, Chrysosporium merdarium, Chrysosporium pannicola, Chrysosporium queenslandicum, Chrysosporium tropicum, Chrysosporium zonatum, Fusarium bactridioides, Fusarium cerealis, Fusarium crookwellense, Fusarium culmorum, Fusarium graminearum, Fusarium graminum, Fusarium heterosporum, Fusarium negundi, Fusarium oxysporum, Fusarium reticulatum, Fusarium roseum, Fusarium sambucinum, Fusarium sarcochroum, Fusarium sporotrichioides, Fusarium sulphureum, Fusarium torulosum, Fusarium trichothecioides, Fusarium venenatum, Humicola grisea, Humicola insolens, Humicola lanuginosa, Irpex lacteus, Mucor miehei, Myceliophthora thermophila, Neurospora crassa, Penicillium funiculosum, Penicillium purpurogenum, Phanerochaete chrysosporium, Thielavia achromatica, Thielavia albomyces, Thielavia albopilosa, Thielavia australeinsis, Thielavia fimeti, Thielavia microspora, Thielavia ovispora, Thielavia peruviana, Thielavia setosa, Thielavia spededonium, Thielavia subthermophila, Thielavia terrestris, Trichoderma harzianum, Trichoderma koningii, Trichoderma longibrachiatum, Trichoderma reesei*, or *Trichoderma viride* lipase.

In another aspect, the parent is a *Humicola lanuginosa* lipase, e.g., the lipase of SEQ ID NO: 2 or the mature polypeptide thereof.

It will be understood that for the aforementioned species, the invention encompasses both the perfect and imperfect states, and other taxonomic equivalents, e.g., anamorphs, regardless of the species name by which they are known. Those skilled in the art will readily recognize the identity of appropriate equivalents.

Strains of these species are readily accessible to the public in a number of culture collections, such as the American Type Culture Collection (ATCC), Deutsche Sammlung von Mikroorganismen and Zellkulturen GmbH (DSMZ), Centraalbureau Voor Schimmelcultures (CBS), and Agricultural Research Service Patent Culture Collection, Northern Regional Research Center (NRRL).

The parent may be identified and obtained from other sources including microorganisms isolated from nature (e.g., soil, composts, water, etc.) or DNA samples obtained directly from natural materials (e.g., soil, composts, water, etc.) using the above-mentioned probes. Techniques for isolating microorganisms and DNA directly from natural habitats are well known in the art. A polynucleotide encoding a parent may then be obtained by similarly screening a genomic DNA or cDNA library of another microorganism or mixed DNA sample. Once a polynucleotide encoding a parent has been detected with the probe(s), the polynucleotide can be isolated or cloned by utilizing techniques that are known to those of ordinary skill in the art (see, e.g., Sambrook et al., 1989, supra).

Compositions

In one embodiment, the invention is directed to detergent compositions comprising lipase variant in combination with one or more additional cleaning composition components. The choice of additional components is within the skill of the artisan and includes conventional ingredients, including the exemplary non-limiting components set forth below.

The choice of components may include, for laundry applications, the consideration of the type of textile to be cleaned, the type and/or degree of soiling, the temperature at which cleaning is to take place, and the formulation of the detergent product. Although components mentioned below are categorized by general header according to a particular functionality, this is not to be construed as a limitation, as a component may comprise additional functionalities as will be appreciated by the skilled artisan.

Enzymes

In one embodiment of the present invention, the lipase variant may be added to a detergent composition in an amount corresponding to 0.001-100 mg protein per liter wash liquor, such as 0.01-100; 0.005-50; 0.01-25; 0.05-10; 0.05-5; or 0.01-1 mg protein per liter wash liquor. Likewise the lipase variant may be added to a detergent composition in an amount corresponding to 0.001-1000 mg protein per g detergent, such as 0.01-1000; 0.005-500; 0.01-250; 0.05-100; 0.05-50; 0.01-10; or 0.02-2 mg protein per g detergent.

The detergent composition may further comprise one or more additional enzymes such as protease, lipase, cutinase, amylase, carbohydrase, cellulase, pectinase, mannanase, arabinase, galactanase, xylanase, oxidase, e.g., a laccase, and/or peroxidase.

In general the properties of all the enzyme(s) comprised, i.e. both the lipase variant(s) as well as additional enzymes should be compatible with the selected detergent, (i.e., pH-optimum, compatibility with other enzymatic and non-enzymatic ingredients, etc.), and the enzyme(s) should be present in effective amounts. In one embodiment of the present invention, the enzyme(s) may be added to a detergent composition in an amount corresponding to 0.001-100 mg protein per liter wash liquor, such as 0.01-100; 0.005-50; 0.01-25; 0.05-10; 0.05-5; or 0.01-1 mg protein per liter wash liquor. Likewise the enzyme(s) may be added to a detergent composition in an amount corresponding to 0.001-1000 mg protein per g detergent, such as 0.01-1000; 0.005-500; 0.01-250; 0.05-100; 0.05-50; 0.01-10; or 0.02-2 mg protein per g detergent.

The enzyme(s) may be stabilized using conventional stabilizing agents, e.g., a polyol such as propylene glycol (1,2-propanediol), glycerol, sorbitol, hexylene glycol, a sugar or sugar alcohol, lactic acid, boric acid, or a boric acid derivative, e.g., an aromatic borate ester, or a phenyl boronic acid derivative such as 4-formylphenyl boronic acid or a peptide aldehyde; preferably a tri- or tetrapeptide aldehyde, potentially as its hydrosulfite adduct, and the composition may be formulated as described in, for example, WO92/19709 and WO92/19708.

Cellulases: Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and WO89/09259.

Especially suitable cellulases are the alkaline or neutral cellulases having color care benefits. Examples of such cellulases are cellulases described in EPO495257, EP0531372, WO96/11262, WO96/29397, WO98/08940. Other examples are cellulase variants such as those described in WO94/07998, EP0531315, U.S. Pat. Nos. 5,457,046, 5,686,593, 5,763,254, WO95/24471, WO98/12307 and PCT/DK98/00299.

Commercially available cellulases include Celluzyme™, and Carezyme™ Endolase; Celluclean, (Novozymes NS), Clazinase™, and Puradax HA™ (Genencor International Inc.), and KAC-500(B)™ (Kao Corporation).

Proteases: Suitable proteases include those of animal, vegetable or microbial origin. Microbial origin is preferred. Chemically modified or protein engineered mutants are included. The protease may be a serine protease or a metalloprotease, preferably an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO89/06279). Examples of trypsin-like proteases are trypsin (e.g., of porcine or bovine origin) and the *Fusarium* protease described in WO89/06270 and WO94/25583.

Examples of useful proteases are the variants described in WO92/19729, WO98/20115, WO98/20116, and WO98/34946, especially the variants with substitutions in one or more of the following positions: 27, 36, 57, 76, 87, 97, 101, 104, 120, 123, 167, 170, 194, 206, 218, 222, 224, 235, and 274.

Preferred commercially available protease enzymes include Alcalase™, Savinase™, Primase™, Duralase™, Esperase™, Kannase™ Liquanase™, Everlase™, Durazym™, Ovozyme™, Coronase™, Relase™, Polarzyme™, Blaze™, Neutrase (Novozymes NS), Maxatase™, Maxacal™, Maxapem™, Properase™, Purafect™, Purafect OxP™, Opticlean™, Purafect Ox™, Purafact Prime™, Excellase™ FN2™, and FN3™ FN4™ (Genencor International Inc.). Other examples are Primase™ and Duralase™. Blap R, Blap S and BlapX available from Henkel.

Lipases and Cutinases: Suitable lipases and cutinases include those of bacterial or fungal origin. Chemically modified or protein engineered mutant enzymes are included. Examples include lipase from *Thermomyces*, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), P. sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include include Lipolase™, Lipex™; Lipolex™ and Lipoclean™ (Novozymes NS), Lumafast (originally from Genencor) and Lipomax (originally from Gist-Brocades).

Still other examples are lipases sometimes referred to as acyltransferases or perhydrolases, e.g. acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

Amylases: Suitable amylases (α and/or β) include those of bacterial or fungal origin. Chemically modified or protein engineered mutants are included. Amylases include, for example, α-amylases obtained from *Bacillus*, e.g., a special strain of *Bacillus licheniformis*, described in more detail in GB 1,296,839.

Examples of useful amylases are the variants described in WO94/02597, WO94/18314, WO96/23873, and WO97/43424, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

Commercially available amylases are Stainzyme; Stainzyme Plus; Duramyl™, Termamyl™, Termamyl Ultra; Natalase, Fungamyl™ and BAN™ (Novozymes NS), Rapidase™ and Purastar™ (from Genencor International Inc.).

Peroxidases/Oxidases: Suitable peroxidases/oxidases include those of plant, bacterial or fungal origin. Chemically modified or protein engineered mutants are included. Examples of useful peroxidases include peroxidases from *Coprinus*, e.g., from *C. cinereus*, and variants thereof as those described in WO93/24618, WO95/10602, and WO98/15257.

Commercially available peroxidases include Guardzyme™ (Novozymes NS).

The detergent enzyme(s) may be included in a detergent composition by adding separate additives containing one or more enzymes, or by adding a combined additive comprising all of these enzymes. A detergent additive of the invention, i.e., a separate additive or a combined additive, can be formulated, for example, as a granulate, a liquid, a slurry, etc. Preferred detergent additive formulations are granulates, in particular non-dusting granulates, liquids, in particular stabilized liquids, or slurries.

Non-dusting granulates may be produced, e.g., as disclosed in U.S. Pat. Nos. 4,106,991 and 4,661,452 and may optionally be coated by methods known in the art. Examples of waxy coating materials are poly(ethylene oxide) products (polyethyleneglycol, PEG) with mean molar weights of 1000 to 20000; ethoxylated nonylphenols having from 16 to 50 ethylene oxide units; ethoxylated fatty alcohols in which the alcohol contains from 12 to 20 carbon atoms and in which there are 15 to 80 ethylene oxide units; fatty alcohols; fatty acids; and mono- and di- and triglycerides of fatty acids. Examples of film-forming coating materials suitable for application by fluid bed techniques are given in GB1483591. Liquid enzyme preparations may, for instance, be stabilized by adding a polyol such as propylene glycol, glycerol, sorbitol, a sugar or sugar alcohol, salts, lactic acid boric acid, an aromatic borate ester, or a phenyl boronic acid derivative such as 4-formylphenyl boronic acid or a peptide aldehyde; preferably a tri- or tetrapeptide aldehyde, potentially as its hydrosulfite adduct according to established methods. Protected enzymes may be prepared according to the method disclosed in EP238216.

Surfactants

The detergent composition of the invention comprises at least one anionic surfactant. In some embodiments the composition may further comprise one or more surfactants, which may be cationic, non-ionic, semi-polar, zwitterionic, or any mixture thereof. In a particular embodiment, the detergent composition includes a mixture of one or more anionic surfactants and one or more nonionic surfactants. The surfactant(s) is typically present at a total level of from 0.1 to about 70 wt %, such as from 1 to about 60 wt %; from 2 to about 50 wt %; from 3 to about 40 wt %; from 4 to about 30 wt %; from 5 to about 25 wt %; or from 10 to about 20 wt %. The surfactant(s) is chosen based on the desired cleaning application, and includes any conventional surfactant(s) known in the art. Any surfactant known in the art for use in detergents may be utilized.

Suitable anionic surfactants include: alkyl sulphates; alkyl sulphonates; alkyl phosphates; alkyl phosphonates; alkyl carboxylates; and mixtures thereof. The anionic surfactant can be selected from the group consisting of: C10-C18 alkyl benzene sulphonates (LAS) preferably C10-C13 alkyl benzene sulphonates; C10-C20 primary, branched chain, linear-chain and random-chain alkyl sulphates (AS), typically having the following formula: $CH_3(CH_2)_xCH_2—OSO_3^-M^+$, wherein, M is hydrogen or a cation which provides charge neutrality, preferred cations are sodium and ammonium cations, wherein x is an integer of at least 7, preferably at least 9; C10-C18 secondary (2,3) alkyl sulphates, typically having the following formulae:

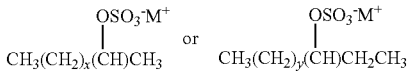

wherein, M is hydrogen or a cation which provides charge neutrality, cations include sodium and ammonium cations, wherein x is an integer of at least 7, or at least 9, y is an integer of at least 8, or at least 9; C10-C18 alkyl alkoxy carboxylates; mid-chain branched alkyl sulphates as described in more detail in U.S. Pat. Nos. 6,020,303 and 6,060,443; modified alkylbenzene sulphonate (MLAS) as described in more detail in WO99/05243, WO99/05242, WO99/05244, WO99/05082, WO99/05084, WO99/05241, WO99/07656, WO00/23549, and WO00/23548; methyl ester sulphonate (MES); alpha-olefin sulphonate (AOS) and mixtures thereof.

Anionic surfactants include: linear or branched, substituted or unsubstituted alkyl benzene sulphonate surfactants, preferably linear C8-C18 alkyl benzene sulphonate surfactants; linear or branched, substituted or unsubstituted alkyl benzene sulphate surfactants; linear or branched, substituted or unsubstituted alkyl sulphate surfactants, including linear C8-C18 alkyl sulphate surfactants, C1-C3 alkyl branched C8-C18 alkyl sulphate surfactants, linear or branched alkoxylated C8-C18 alkyl sulphate surfactants and mixtures thereof; linear or branched, substituted or unsubstituted alkyl sulphonate surfactants; and mixtures thereof.

Alkoxylated alkyl sulphate surfactants may be linear or branched, substituted or unsubstituted C8-18 alkyl alkoxylated sulphate surfactants having an average degree of alkoxylation of from 1 to 30, from 1 to 10, or from 3 to 7.

Anionic surfactants may be selected from the group consisting of: linear or branched, substituted or unsubstituted, C12-18 alkyl sulphates; linear or branched, substituted or unsubstituted, C10-13 alkylbenzene sulphonates, preferably linear C10-13 alkylbenzene sulphonates; and mixtures thereof. Highly preferred are linear C10-13 alkylbenzene sulphonates. Highly preferred are linear C10-13 alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem(R) or those supplied by Petresa under the tradename Petrelab(R), other suitable LAB include high 2-phenyl LAB, such as those supplied by Sasol under the tradename Hyblene(R). A suitable anionic detersive surfactant is alkyl benzene sulphonate that is obtained by DETAL catalyzed process, although other synthesis routes, such as HF, may also be suitable. Another suitable anionic surfactant is alkyl ethoxy carboxylate.

The anionic surfactants are typically present in their salt form, typically being complexed with a suitable cation. Suitable counter-ions include $Na^+$ and $K^+$, substituted ammonium such as Ci-$C_6$ alkanolammnonium preferably mono-ethanolamine (MEA) tri-ethanolamine (TEA), di-ethanolamine (DEA), and any mixtures thereof. In some embodiments at least 20 wt %, or at least 30 wt %, or at least 40 wt %, or at least 50 wt %, or at least 60 wt %, or at least 70 wt %, or at least 80 wt %, or even or at least 90 wt % of the anionic surfactant is neutralized by a sodium cation.

The anionic surfactant may have a hydrophilic index (Hlc) of from 8.0 to 9.1, or it may even have a lower hydrophilic index (Hlc), such as one in the range of from 6.0 to 8.0, or from 7.0 to below 8.0. The hydrophilic index (Hlc) is described in more detail in WO00/27958.

The detergent will usually contain from 0.1 to 70 wt %, such as from 1 to about 60 wt %; from 2 to about 50 wt %; from 3 to about 40 wt %; from 4 to about 30 wt %; from 5 to about 25 wt %; or from 10 to about 20 wt % of an anionic surfactant. Non-limiting examples of preferred anionic surfactants include sulfates and sulfonates, in particular, linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or soap, and combinations thereof.

When included therein the detergent will usually contain from 0.01 to about 40 wt %; such as from 0.05 to about 10 wt %; from 0.1 to 5 wt % of a cationic surfactant. Non-limiting examples of cationic surfactants include alklydimethylehanolamine quat (ADMEAQ), cetyltrimethylammonium bromide (CTAB), dimethyldistearylammonium chloride (DSDMAC), and alkylbenzyldimethylammonium, and combinations thereof, Alkyl quaternary ammonium compounds, Alkoxylated quaternary ammonium (AQA), When included therein the detergent will usually contain from 0.2 to about 60 wt % or even from 40 to about 70 wt % of a nonionic surfactant, for example from 0.5 to about 40 wt %, from 1 to about 30 wt %; from 1 to about 20 wt %, from 3 to about 10 wt %, from 2 to about 5 wt %, or from 6 to about 15 wt %. Non-limiting examples of nonionic surfactants include alcohol ethoxylates (AE or AEO), alcohol propoxylates, propoxylated fatty alcohols (PFA), alkoxylated fatty acid alkyl esters, such as ethoxylated and/or propoxylated fatty acid alkyl esters, alkylphenol ethoxylates (APE), nonylphenol ethoxylates (NPE), alkylpolyglycosides (APG), alkoxylated amines, fatty acid monoethanolamides (FAM), fatty acid diethanolamides (FADA), ethoxylated fatty acid monoethanolamides (EFAM), propoxylated fatty acid monoethanolamide (PFAM), polyhydroxy alkyl fatty acid amides, or N-acyl N-alkyl derivatives of glucosamine (glucamides, GA, or fatty acid glucamide, FAGA), as well as products available under the trade names SPAN and TWEEN, and combinations thereof.

When included therein the detergent will usually contain from about 0.1 to about 40 wt % of a semipolar surfactant, for example from about 0.5 to about 30 wt %, from about 1 to about 20 wt %, from about 3 to about 10 wt %, from about 3 to about 5 wt %, or from about 8 to about 12 wt %. Non-limiting examples of semipolar surfactants include amine oxides (AO) such as alkyldimethylamineoxide, N-(coco alkyl)-N,N-dimethylamine oxide and N-(tallow-alkyl)-N,N-bis(2-hydroxyethyl)amine oxide, fatty acid alkanolamides and ethoxylated fatty acid alkanolamides, and combinations thereof.

When included therein the detergent will usually contain from about 0.2 to about 40 wt % of a zwitterionic surfactant, for example from about 0.5 to about 30 wt %, from about 1 to about 20 wt %, from about 3 to about 10 wt %, from about 3 to about 5 wt %, or from about 8 to about 12 wt %. Non-limiting examples of zwitterionic surfactants include betaine, alkyldimethylbetaine, and sulfobetaine, and combinations thereof.

Hydrotropes

A hydrotrope is a compound that solubilises hydrophobic compounds in aqueous solutions (or oppositely, polar substances in a non-polar environment). Use of hydrotropes in detergent compositions allow for example more concentrated formulations of surfactants (as in the process of compacting liquid detergents by removing water) without inducing undesired phenomena such as phase separation or high viscosity.

The detergent may contain from 0 to about 10 wt %, such as from 0.5 to about 5 wt %, or from 3 to about 5 wt %, of a hydrotrope. It may in some cases contain from 0 to about 50 wt %, such as from 0 to about 25 wt % or from 25 to about 50 wt % of a hydrotrope. Any hydrotrope known in the art for use in detergents may be utilized. Non-limiting examples of hydrotropes include sodium benzene sulfonate, sodium p-toluene sulfonates (STS), sodium xylene sulfonates (SXS), sodium cumene sulfonates (SCS), sodium cymene sulfonate, amine oxides, alcohols and polyglycolethers, sodium hydroxynaphthoate, sodium hydroxynaphthalene sulfonate, sodium ethylhexyl sulfate, polyols and combinations thereof.

Builders and Co-Builders

The detergent composition may contain from 0 to about 65 wt % or from 0 to about 20 wt % of detergent builder, co-builder, or mixtures thereof. In a dish wash detergent, the level of builder is typically from 40 to about 65 wt %, or from 50 to about 65 wt %. The builder and/or co-builder may particularly be a chelating agent that forms water-soluble complexes with Ca and Mg. Any builder and/or co-builder known in the art for use in detergents may be utilized.

Non-limiting examples of builders include zeolites, diphosphates (pyrophosphates), triphosphates such as sodium triphosphate (STP or STPP), carbonates such as sodium carbonate, soluble silicates such as sodium metasilicate, layered silicates (e.g., SKS-6 from Hoechst), such as 2-aminoethan-1-ol (MEA), iminodiethanol (DEA) and 2,2',2"-nitrilotriethanol (TEA), and carboxymethylinulin (CMI), and any combinations thereof.

Non-limiting examples of co-builders include homopolymers of polyacrylates or copolymers thereof, such as poly (acrylic acid) (PAA) or copoly(acrylic acid/maleic acid) (PAA/PMA). Further non-limiting examples include citrate, chelators such as aminocarboxylates, aminopolycarboxylates and phosphonates, and alkyl- or alkenylsuccinic acid. Additional specific examples include 2,2',2"-nitrilotriacetic acid (NTA), etheylenediaminetetraacetic acid (EDTA), diethylenetriaminepentaacetic acid (DTPA), iminodisuccinic acid (IDS), ethylenediamine-N,N'-disuccinic acid (EDDS), methylglycinediacetic acid (MGDA), glutamic acid-N,N-diacetic acid (GLDA), 1-hydroxyethane-1,1-diyl-bis(phosphonic acid) (HEDP), ethylenediaminetetrakis(methylene)tetrakis(phosphonic acid) (EDTMPA), diethylenetriaminepentakis(methylene)pentakis(phosphonic acid) (DTPMPA), N-(2-hydroxyethyl)iminodiacetic acid (EDG), aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), α-alanine-N,N-diacetic acid (α-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA), N-(hydroxyethyl)-ethylidenediaminetriacetate (HEDTA), diethanolglycine (DEG), Diethylenetriamine Penta (Methylene Phosphonic acid) (DTPMP), aminotris(methylenephosphonic acid) (ATMP), diethylene triamine pentaacetic acid (DTPA) and any combinations and salts thereof. Further exemplary builders and/or co-builders are described in, e.g., WO 09/102854, U.S. Pat. No. 5,977,053

Bleaching Systems

The detergent may contain from 0 to about 50 wt %, from 0.1 to about 25 wt %, from 0.5 to about 20 wt %, from 1 to about 15 wt % or from 2 to about 10 wt % of a bleaching system. Any bleaching system known in the art for use in detergents may be utilized. Suitable bleaching system components include bleaching catalysts, photobleaches, bleach activators, sources of hydrogen peroxide such as sodium percarbonate and sodium perborates, preformed peracids and mixtures thereof. Suitable preformed peracids include, but are not limited to, peroxycarboxylic acids and salts, percarbonic acids and salts, perimidic acids and salts, peroxymonosulfuric acids and salts, for example, Oxone (R), and mixtures thereof. Non-limiting examples of bleaching systems include peroxide-based bleaching systems, which may comprise, for example, an inorganic salt, including alkali metal salts such as sodium salts of perborate (usually mono- or tetra-hydrate), percarbonate, persulfate, perphosphate, persilicate salts, in combination with a peracid-forming bleach activator. By Bleach activator is meant herin a compound which reacts with peroxygen bleach like hydrogen peroxide to form a Peracid. The peracid thus formed constitutes the activated bleach. Suitable bleach activators to be used herin include those belonging to the class of esters amides, imides or anhydrides, Suitable examples are tetracetyl athylene diamine (TAED), sodium 3,5,5 trimethyl hexanoyloxybenzene sulphonat, diperoxy dodecanoic acid, 4-(dodecanoyloxy)benzenesulfonate (LOBS), 4-(decanoyloxy)benzenesulfonate, 4-(decanoyloxy)benzoate (DOBS), 4-(3,5,5-trimethylhexanoyloxy)benzenesulfonate (ISONOBS), tetraacetylethylenediamine (TAED) and 4-(nonanoyloxy)benzenesulfonate (NOBS), and/or those disclosed in WO98/17767. A particular family of bleach activators of interest was disclosed in EP624154 and particularly preferred in that family is acetyl triethyl citrate (ATC). ATC or a short chain triglyceride like Triacin has the advantage that it is environmental friendly as it eventually degrades into citric acid and alcohol. Furthermore acethyl triethyl citrate and triacetin has a good hydrolytical stability in the product upon storage and it is an efficient bleach activator. Finally ATC provides a good building capacity to the laundry additive. Alternatively, the bleaching system may comprise peroxyacids of, for example, the amide, imide, or sulfone type. The bleaching system may also comprise peracids such as 6-(phthaloylamino)percapronic acid (PAP). The bleaching system may also include a bleach catalyst. In some embodiments the bleach component may be an organic catalyst selected from the group consisting of organic catalysts having the following formulae:

(i)

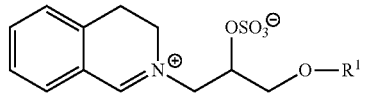

(ii)

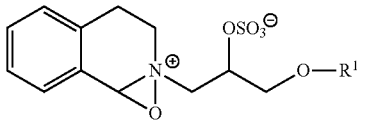

(iii) and mixtures thereof; wherein each $R^1$ is independently a branched alkyl group containing from 9 to 24 carbons or linear alkyl group containing from 11 to 24 carbons, preferably each $R^1$ is independently a branched alkyl group containing from 9 to 18 carbons or linear alkyl group containing from 11 to 18 carbons, more preferably each $R^1$ is independently selected from the group consisting of 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl. Other exemplary bleaching systems are described, e.g., in WO07/087258, WO07/087244, WO07/087259, WO07/087242. Suitable photobleaches may for example be sulfonated zinc phthalocyanine Polymers The detergent may contain from 0 to about 10 wt %, such as from 0.5 to about 5 wt %, from 2 to about 5 wt %, from 0.5 to about 2 wt % or from 0.2 to about 1 wt % of a polymer. Any polymer known in the art for use in detergents may be utilized. The polymer may function as a co-builder as mentioned above, or may provide antiredeposition, fiber protection, soil release, dye transfer inhibition, grease cleaning and/or anti-foaming properties. Some polymers may have more than one of the above-mentioned properties and/or more than one of the below-mentioned motifs.

Exemplary polymers include (carboxymethyl)cellulose (CMC), poly(vinyl alcohol) (PVA), poly(vinylpyrrolidone) (PVP), poly(ethyleneglycol) or poly(ethylene oxide) (PEG), ethoxylated poly(ethyleneimine), carboxymethyl inulin (CMI), and polycarboxylates such as PAA, PAA/PMA, poly-aspartic acid, and lauryl methacrylate/acrylic acid copolymers, hydrophobically modified CMC (HM-CMC) and silicones, copolymers of terephthalic acid and oligomeric glycols, copolymers of polyethylene terephthalate and polyoxyethene terephthalate (PET-POET), PVP, poly(vinylimidazole) (PVI), poly(vinylpyridin-N-oxide) (PVPO or PVPNO) and polyvinylpyrrolidone-vinylimidazole (PVPVI). Further exemplary polymers include sulfonated polycarboxylates, polyethylene oxide and polypropylene oxide (PEO-PPO) and diquaternium ethoxy sulfate. Other exemplary polymers are disclosed in, e.g., WO06/130575. Salts of the above-mentioned polymers are also contemplated.

The polymer may also be a surfactancy boosting polymer. Preferred polymers are amphiphilic alkoxylated grease cleaning polymers and/or random graft co-polymers. Amphiphilic alkoxylated grease cleaning polymers refer to any alkoxylated polymers having balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure. The core structure may comprise a polyalkylenimine structure or a polyalkanolamine structure as described in WO11/156297.

Fabric Hueing Agent Dye

The detergent compositions of the present invention may also include fabric hueing agent dyes. Hueing agents are formulated to deposit onto fabrics from the wash liquor so as to improve fabric whiteness perception. Fluorescent whitening agents emit at least some visible light. In contrast, hueing agents alter the tint of a surface as they absorb at least a portion of the visible light spectrum. Suitable hueing agents include dyes and dye-clay conjugates, and may also include pigments. Suitable dyes include small molecule dyes and polymeric dyes. Suitable small molecule dyes include small molecule dyes selected from the group consisting of dyes falling into the Color Index (C.I.) classifications of Direct Blue, Direct Red, Direct Violet, Acid Blue, Acid Red, Acid Violet, Basic Blue, Basic Violet and Basic Red, or mixtures thereof, for example as described in WO05/03274, WO05/03275, WO05/03276 and EP1876226 (hereby incorporated by reference).

Preferably the hueing agent is blue or violet. It is preferred that the shading dye(s) have a peak absorption wavelength of from 550 nm to 650 nm, preferably from 570 nm to 630 nm. A combination of dyes which together have the visual effect on the human eye as a single dye having a peak absorption wavelength on polyester of from 550 nm to 650 nm, preferably from 570 nm to 630 nm. This may be provided for example by mixing a red and green-blue dye to yield a blue or violet shade.

Examples of suitable dyes are direct violet 7, direct violet 9, direct violet 11, direct violet 26, direct violet 31, direct violet 35, direct violet 40, direct violet 41, direct violet 51, direct violet 66, direct violet 99, acid violet 50, acid blue 9, acid violet 17, acid black 1, acid red 17, acid blue 29, solvent violet 13, disperse violet 27 disperse violet 26, disperse violet 28, disperse violet 63 and disperse violet 77, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141, thiazolium dyes, reactive blue 19, reactive blue 163, reactive blue 182, reactive blue 96, Liquitint(R) Violet CT (Milliken, Spartanburg, USA) and Azo-CM-Cellulose (Megazyme, Bray, Republic of Ireland).

The detergent composition preferably comprises from 0.00003 to about 0.2 wt %, from 0.00008 to about 0.05 wt %, or even from 0.0001 to about 0.04 wt % fabric hueing agent. The composition may comprise from 0.0001 to 0.2 wt % fabric hueing agent dyes, this may be especially preferred when the composition is in the form of a unit dose pouch. Suitable hueing agents are also disclosed in, e.g., WO07/087257, WO07/087243.

Anti-Foaming Agent

The detergent compositions may comprise from 0.001 to about 4.0 wt % anti-foam selected from silicone anti-foam compounds; anti-foam compounds of silicone oils and hydrophobic particles; and mixtures thereof. In one embodiment, the compositions herein comprise from 0.01 to about 2.0 wt %, or from 0.05 to about 1.0 wt % silicone anti-foam (percentages by active amount not including any carrier). In one embodiment, the anti-foam is selected from: organo modified silicone polymers with aryl or alkylaryl substituents combined with silicone resin and modified silica; M/Q resins; and mixtures thereof.

Calcium and Magnesium Cations

Preferably, the composition comprises from 0.01 to 5.0 wt % of divalent cations, such as calcium and/or magnesium cations. The composition may comprise from 0.01 to 0.2 wt %, from 0.2 to 1.0 wt %, from 1.0 to 2.0 wt %, from 2.0 to 3.0 wt %, from 3.0 to 4.0 wt % or from 4.0 to 5.0 wt %.

Adjunct Materials

Any detergent components known in the art for use in detergents may also be utilized. Other optional detergent components include anti-corrosion agents, anti-shrink agents, anti-soil redeposition agents, anti-wrinkling agents, bactericides, binders, corrosion inhibitors, disintegrants/disintegration agents, dyes, enzyme stabilizers (including boric acid, borates, CMC, protease inhibitors such as 4-FPBA and peptide aldehydes, and/or polyols such as propylene glycol; glycerol, sorbitol and the like), fabric conditioners including clays, fillers/processing aids, fluorescent whitening agents/optical brighteners, foam boosters, foam (suds) regulators, perfumes, soil-suspending agents, softeners, suds suppressors, tarnish inhibitors, and wicking agents, either alone or in combination. Any ingredient known in the art for use in detergents may be utilized. The choice of such ingredients is well within the skill of the artisan.

The detergent compositions of the present invention can also contain dispersants. In particular powdered detergents may comprise dispersants. Suitable water-soluble organic materials include the homo- or co-polymeric acids or their salts, in which the polycarboxylic acid comprises at least two carboxyl radicals separated from each other by not more than two carbon atoms. Suitable dispersants are for example described in Powdered Detergents, Surfactant science series volume 71, Marcel Dekker, Inc.

The detergent compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from 0.0001 to about 10 wt %, from 0.01 to about 5 wt % or from 0.1 to about 3 wt % of the composition.

The detergent compositions of the present invention will preferably also contain additional components that may tint articles being cleaned, such as fluorescent whitening agent or optical brighteners. Where present the brightener is preferably at a level from 0.01 to about 0.5 wt %. Any fluorescent whitening agent suitable for use in a laundry detergent composition may be used in the composition of the present invention. The most commonly used fluorescent whitening agents are those belonging to the classes of diaminostilbene-sulphonic acid derivatives, diarylpyrazoline derivatives and bisphenyl-distyryl derivatives. Examples of the diaminostilbene-sulphonic acid derivative type of fluorescent whitening agents include the sodium salts of: 4,4'-bis-(2-diethanolamino-4-anilino-s-triazin-6-ylamino) stilbene-2,2'-disulphonate; 4,4'-bis-(2,4-dianilino-s-triazin-6-ylamino) stilbene-2.2'-disulphonate; 4,4'-bis-(2-anilino-4(N-methyl-N-2-hydroxy-ethylamino)-s-triazin-6-ylamino) stilbene-2,2'-disulphonate, 4,4'-bis-(4-phenyl-2,1,3-triazol-2-yl)stilbene-2,2'-disulphonate; 4,4'-bis-(2-anilino-4(1-methyl-2-hydroxy-ethylamino)-s-triazin-6-ylamino) stilbene-2,2'-disulphonate and 2-(stilbyl-4"-naptho-1.,2':4,5)-1,2,3-trizole-2"-sulphonate. Preferred fluorescent whitening agents are Tinopal DMS and Tinopal CBS available from Ciba-Geigy AG, Basel, Switzerland. Tinopal DMS is the disodium salt of 4,4'-bis-(2-morpholino-4 anilino-s-triazin-6-ylamino) stilbene disulphonate. Tinopal CBS is the disodium salt of 2,2'-bis-(phenyl-styryl) disulphonate. Also preferred are fluorescent whitening agents is the commercially available Parawhite KX, supplied by Paramount Minerals and Chemicals, Mumbai, India. Other fluorescers suitable for use in the invention include the 1-3-diaryl pyrazolines and the 7-alkylaminocoumarins. Suitable fluorescent brightener levels include lower levels of from 0.01 wt %, from 0.05 wt %, from 0.1 wt % or from 0.2 wt % to upper levels of about 0.5 wt % or about 0.75 wt %.

The detergent compositions of the present invention may also include one or more soil release polymers which aid the removal of soils from fabrics such as cotton and polyester based fabrics, in particular the removal of hydrophobic soils from polyester based fabrics. The soil release polymers may for example be nonionic or anionic terephthalte based polymers, polyvinyl caprolactam and related copolymers, vinyl graft copolymers, polyester polyamides see for example Chapter 7 in Powdered Detergents, Surfactant science series volume 71, Marcel Dekker, Inc. Another type of soil release polymers are amphiphilic alkoxylated grease cleaning polymers comprising a core structure and a plurality of alkoxylate groups attached to that core structure. The core structure may comprise a polyalkylenimine structure or a polyalkanolamine structure as described in detail in WO09/087523 (hereby incorporated by reference). Furthermore random graft co-polymers are suitable soil release polymers Suitable graft co-polymers are described in more detail in WO07/138054, WO06/108856 and WO06/113314 (hereby incorporated by reference). Other soil release polymers are substituted polysaccharide structures especially substituted cellulosic structures such as modified cellulose deriviatives such as those described in EP1867808 or WO03/040279 (both are hereby incorporated by reference). Suitable cellulosic polymers include cellulose, cellulose ethers, cellulose esters, cellulose amides and mixtures thereof. Suitable cellulosic polymers include anionically modified cellulose, nonionically modified cellulose, cationically modified cellulose, zwitterionically modified cellulose, and mixtures thereof. Suitable cellulosic polymers include methyl cellulose, carboxy methyl cellulose, ethyl cellulose, hydroxyl ethyl cellulose, hydroxyl propyl methyl cellulose, ester carboxy methyl cellulose, and mixtures thereof.

The detergent compositions of the present invention may also include one or more anti-redeposition agents such as carboxymethylcellulose (CMC), polyvinyl alcohol (PVA), polyvinylpyrrolidone (PVP), polyoxyethylene and/or polyethyleneglycol (PEG), homopolymers of acrylic acid, copolymers of acrylic acid and maleic acid, and ethoxylated polyethyleneimines. The cellulose based polymers described under soil release polymers above may also function as anti-redeposition agents.

Other suitable adjunct materials include, but are not limited to, anti-shrink agents, anti-wrinkling agents, bactericides, binders, carriers, dyes, enzyme stabilizers, fabric softeners, fillers, foam regulators, hydrotropes, perfumes, pigments, sod suppressors, solvents, and structurants for liquid detergents and/or structure elasticizing agents.

Use

Use in Detergents. The lipases of the present invention may be used to prepare stabilized detergent compositions. Accordingly, the present invention relates to a method of obtaining a detergent composition comprising introducing (a) a lipase variant of a parent lipase which variant has at least 60% sequence identity with SEQ ID NO: 2, a substitution at a position corresponding to D254 of the mature polypeptide of SEQ ID NO: 2 and has lipase activity and (b) an anionic surfactant, wherein said composition has increased stability in comparison with a corresponding composition comprising the parent lipase.

The stability may but is not limited to be monitored by means of real time or accelerated storage stability and/or DSC assays as described herein. They may be added to and thus become a component of a detergent composition. The detergent composition may be in any suitable form including granulated, liquid, gel, paste, soap bar, unit dose/capsule; etc. or any combinations thereof.

The detergent composition of the present invention may be formulated, for example, as a hand or machine laundry detergent composition including a laundry additive composition suitable for pre-treatment of stained fabrics and a rinse added fabric softener composition, or be formulated as a detergent composition for use in general household hard surface cleaning operations, or be formulated for hand or machine dishwashing operations.

In a specific aspect, the present invention provides a detergent additive comprising a polypeptide of the present invention as described herein.

The present invention is also directed to methods for using the compositions thereof.

The present invention also relate to the following embodiments:

1. Use of a lipase variant derived from a parent lipase with at least 60% sequence identity with SEQ ID NO: 2, which variant has lipase activity and in comparison with the parent lipase comprises a substitution at a position corresponding to D254 of the mature polypeptide of SEQ ID NO: 2, for obtaining a detergent composition comprising at least one anionic surfactant which composition is more stable in comparison with a corresponding composition comprising the parent lipase.
2. The use of embodiment 1, wherein the amino acid substitution at the position corresponding to D254 of the mature polypeptide of SEQ ID NO: 2 is S, T, N, Y, H, L, or Q.

3. The use of embodiment 1 or 2, wherein the at least one anionic surfactant is linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid, soap, or any combination thereof.
4. The use of any of embodiments 1-3, wherein the lipase variant is selected from the group consisting of:
a. a polypeptide having at least 60% sequence identity to the mature polypeptide of SEQ ID NO: 2;
b. a polypeptide encoded by a polynucleotide that hybridizes under low stringency conditions with (i) the mature polypeptide coding sequence of SEQ ID NO: 1, (ii) the full-length complement of (i);
c. a polypeptide encoded by a polynucleotide having at least 60% identity to the mature polypeptide coding sequence of SEQ ID NO: 1; and
d. a fragment of the mature polypeptide of SEQ ID NO: 2, which has lipase activity.
5. The use of any of embodiments 1-4, wherein the lipase variant has at least 65%, at least 70%, at least 75%, at least 80%, at least 85%, at least 90%, at least 91%, at least 92%, at least 93%, at least 94%, at least 95%, at least 96%, at least 97%, at least 98%, or at least 99% but less than 100% sequence identity to the mature polypeptide of SEQ ID NO: 2.
6. The use of any of embodiments 1-5, wherein the lipase variant is encoded by a polynucleotide that hybridizes under medium stringency conditions, medium-high stringency conditions, high stringency conditions, or very high stringency conditions with (i) the mature polypeptide coding sequence of SEQ ID NO: 1 or (ii) the full-length complement of (i).
7. The use of any of embodiments 1-6, wherein the number of substitutions are 1-20, e.g., 1-10 and 1-5, such as 1, 2, 3, 4, 5, 6, 7, 8, 9, 10, 11, 12, 13, 14, 15, 16, 17, 18, 19, or 20 substitutions.
8. The use of any of embodiments 1-7, which further comprises a substitution at one or more positions corresponding to positions N33Q, T231R, and/or N233R of the mature polypeptide of SEQ ID NO: 2.
9. The use of any of embodiments 1-8, wherein the lipase variant comprises or contains substitutions selected from:
a. T231R+D254S
b. N233R+D254S
c. T231R+N233R+D254S
d. N33Q+D254S
e. N33Q+T231R+D254S
f. N33Q+N233R+D254S
g. N33Q+T231R+N233R+D254S
h. T231R+D254T
i. N233R+D254T
j. T231R+N233R+D254T
k. N33Q+D254T
l. N33Q+T231R+D254T
m. N33Q+N233R+D254T
n. N33Q+T231R+N233R+D254T
o. T231R+D254N
p. N233R+D254N
q. T231R+N233R+D254N
r. N33Q+D254N
s. N33Q+T231R+D254N
t. N33Q+N233R+D254N
u. N33Q+T231R+N233R+D254N
v. T231R+D254Y
w. N233R+D254Y
x. T231R+N233R+D254Y
y. N33Q+D254Y
z. N33Q+T231R+D254Y
aa. N33Q+N233R+D254Y
bb. N33Q+T231R+N233R+D254Y
cc. T231R+D254H
dd. N233R+D254H
ee. T231R+N233R+D254H
ff. N33Q+D254H
gg. N33Q+T231R+D254H
hh. N33Q+N233R+D254H
ii. N33Q+T231R+N233R+D254H
jj. T231R+D254L
kk. N233R+D254L
ll. T231R+N233R+D254L
mm. N33Q+D254L
nn. N33Q+T231R+D254L
oo. N33Q+N233R+D254L
pp. N33Q+T231R+N233R+D254L
qq. T231R+D254Q
rr. N233R+D254Q
ss. T231R+N233R+D254Q
tt. N33Q+D254Q
uu. N33Q+T231R+D254Q
vv. N33Q+N233R+D254Q
ww. N33Q+T231R+N233R+D254Q
10. The use of any of the preceding embodiments, wherein the parent lipase comprises or consists of the mature polypeptide of SEQ ID NO: 2.
11. The use of any of the preceding embodiments, wherein the composition further comprises $CaCl_2$.
12. A detergent composition obtained by the use of a lipase variant according to any of embodiments 1-11.
13. A detergent composition comprising (a) a lipase variant of a parent lipase which variant has a substitution at a position corresponding to D254 of the mature polypeptide of SEQ ID NO: 2 and has lipase activity and (b) an anionic surfactant, wherein said composition has increased stability in comparison with a corresponding composition comprising the parent lipase.
14. A method of obtaining a detergent composition comprising introducing (a) a lipase variant of a parent lipase which variant has a substitution at a position corresponding to D254 of the mature polypeptide of SEQ ID NO: 2 and has lipase activity and (b) an anionic surfactant, wherein said composition has increased stability in comparison with a corresponding composition comprising the parent lipase.
15. Use of the composition of embodiments 12 or 13 for cleaning.

The present invention is further described by the following examples that should not be construed as limiting the scope of the invention.

EXAMPLES

Example 1

Differential Scanning Calorimetry (DSC)

The thermostability of the lipases was determined by Differential Scanning calorimetry (DSC) using a VP-Capillary Differential Scanning calorimeter (MicroCal Inc., Piscataway, N.J., USA). The thermal denaturation temperature, Td (° C.), was taken as the top of denaturation peak (major endothermic peak) in thermograms (Cp vs. T) obtained after heating enzyme solutions in buffer (50 mM HEPES buffer pH 8.0 with or without 1 mM $CaCl_2$ added) at a constant programmed heating rate of 200 K/hr.

Sample- and reference-solutions (approximately 0.2 ml) were loaded into the calorimeter (reference: buffer without enzyme) from storage conditions at 10° C. and thermally pre-equilibrated for 20 minutes at 20° C. prior to DSC scan from 20° C. to 110° C. Denaturation temperatures were determined with an accuracy of approximately +/−1° C.

Example 2a

Real Time Storage Stability Assay

Purified lipase were diluted with HSB buffer (2.5 mM HEPES pH 7; 10 M NaCl; 0.02% Brij-35) to a concentration of 100 ppm. 20 microliter of the 100 ppm lipase solution was added to a 180 microliter detergent composition, stirred for 5 minutes and sealed. Samples were stored at 4° C. (no stressed) and 35° C. (stressed). Storage times were chosen according to the half life of the lipase reference.

After storage possible condensation liquid was collected by centrifugation. 10 microliter sample aliquots were diluted 200-fold in a 0.05M pH 9 borate buffer (9 mM CaCl2; 0.0225% Brij-35; 0.85% 4-FBPA (31.5 g/l)). One part diluted aliquot was mixed with four parts of 1 mM pNP-palmitate, 1 mM calcium chloride, 100 mM Tris (pH 8.0), 6.5 mM Deoxycholate, 1.4 g/L AOS and release of the pNP chromophore was measured spectrophotometrically for 20 minutes.

Residual activity was calculated as the ratio of the measured velocities of stressed versus no stressed sample. The average value of the residual activity was calculated based on two to four replicates.

Half life shown in experiments 6, 7 and 8 was calculated based on the following formula:

$$\text{Half life}=\text{Stress time}*\ln(0.5)/\ln(\text{residual activity}).$$

The half life improvement factor (HIF) relative to a lipase reference was calculated by dividing the half life of the lipase with the half life of the lipase reference. The lipase reference was unless otherwise mentioned a *Thermomyces lanuginosus* lipase comprising the mutations T231R and N233R.

TABLE 1

| Composition | D001 (wt %) | D003 (wt %) |
|---|---|---|
| Soft water | 49% | 52% |
| NaOH, pellets | 3% | 3% |
| Linear alkyl sulfonic (LAS) acid | 12% | — |
| Sodium Laureth sulfate (SLES) (70%*) | — | 8.4% |
| Soy fatty acid (Edenor SJ,) | 6% | 6% |
| Coco fatty acid (Radiacid 0631) | 5% | 5% |

TABLE 1-continued

| Composition | D001 (wt %) | D003 (wt %) |
|---|---|---|
| Alkyl ethoxylate C13AE8EO; (90%*) | 10% | 10% |
| Triethanol amine (99/90%*) | 2% | 2% |
| Na-citrate, dihydrate | 1% | 1% |
| DTPMPA; diethylenetriaminepentakis(methylenephosphonic) acid (Dequest 2066 C2) | 3% | 3% |
| Propylene glycol | 5% | 5% |
| EtOH (99.9%*) | 5% | 5% |
| Colorant | added | — |
| Opacifier (Syntran 5909.35 w %*) | 0.10% | — |
| pH | 8.4 | 8.4 |
| Main anionic | LAS:soap 1.2:1 | SLES:soap 1.2:1 |
| AI/NI (incl soap) | 2.3:1 | 2.3:1 |
| AI/NI (excl soap) | 1.2:1 | 1.2:1 |

*amounts are based on the actual dry matter contents.

D002 is a commercial detergent (Persil Small & Mighty nonbio, 2x concentrated) without enzymes bought in UK 2010. It is based on LAS/SLES/NI and has pH 8.4 measured straight in.

Example 2b

Real Time Storage Stability Assay in the Presence of Anionic Surfactants

A simple assay system was set up to test the stability in the presence of an anionic surfactant such as LAS.

TABLE 2

| Composition | X001 | X002 | X013 |
|---|---|---|---|
| LAS | 11.1% | 11.1% | — |
| TRIS | 22.2 mM | 22.2 mM | 22.2 mM |
| NaCl | 111.1 mM | 111.1 mM | 111.1 mM |
| pH | 7 | 9 | 7 |

Purified lipase was diluted with HSB buffer (2.5 mM HEPES pH 7; 10 mM NaCl; 0.02% Brij-35) to a concentration of 100 ppm. 20 microliter of the 100 ppm lipase solution was added to a 180 microliter buffer solution, stirred for 5 minutes and sealed. Samples were stored at room temperature in a reference buffer X013 without surfactants (no stressed) and in a buffer with surfactants X001 or X002 (stressed). Sample aliquots of four replicates were taken after 1, 2, 3, 4, 6, 24, and 48 hours.

After storage possible condensation liquid was collected by centrifugation. 10 microliter sample aliquots were diluted 200-fold in a 0.05M pH 9 borate buffer (9 mM CaCl2; 0.0225% Brij-35; 0.85% 4-FBPA (31.5 g/l)). One part diluted aliquot was mixed with four parts of 1 mM pNP-palmitate, 1 mM calcium chloride, 100 mM Tris (pH 8.0), 6.5 mM Deoxycholate, 1.4 g/L AOS and release of the pNP chromophore was measured spectrophotometrically for 20 minutes.

Residual activity was calculated as the ratio of the measured velocities of stressed versus no stressed sample. The average value of the residual activity was calculated based on two to four replicates.

Half life was calculated by fitting a curve of the type $y=A*2^{(-x/B)}$ where y is the residual activity, and x is the incubation time. The optimal value of B is then the half-life. The fit is done using the nls-function in R (available on the internet at r-project.org).

Example 2c

Real Time Storage Stability Assay

Purified lipase in a 2 mg EP/g stock solution was added to 96.3% detergent in a concentration of 68 ppm. The samples were stirred for minimum 1 hour prior to distribution into sealed glass vials followed by storage. After end storage, all samples were frozen and analyzed for residual activity and compared to a reference sample which was frozen from the start of the experiment. The lipase reference was unless otherwise mentioned a *Thermomyces lanuginosus* lipase comprising the mutations T231R and N233R.

Lipase activity was measured by a method where the lipase enzyme was diluted to 0.0145-0.0490 M:LCLU/L and incubated (pH 8; 37° C.) with the substrate PNP-palmitate; the released PNP was detected spectrophotometrically over 65 seconds at 405 nm. The absolute activity is read relative to a standard curve. The average value of the absolute activity was calculated based on two replicates.

Half life was calculated by fitting a curve of the type y=A*2^(−x/B) where y is the residual activity, and x is the incubation time. The optimal value of B is then the half-life. The fit is done using the nls-function in R (available on the internet at r-project.org).

Example 3

Thermo stability

The thermo stability was determined as described in example 1 in the absence of $CaCl_2$. The thermal denaturation temperature, Td in the absence or presence of LAS for a D254S substituted lipase variant and its reference lipase are shown in table 3.

TABLE 3

| Mutations | Td (° C.) | Td(L) + 0.5 mM LAS (° C.) |
|---|---|---|
| T231R + N233R | 74.4 | 72.1 |
| T231R + N233R + D254S | 76.1 | 77.6 |

Example 4

Thermo Stability

The thermo stability was determined as described in example 1 in the presence of $CaCl_2$. The thermal denaturation temperature, Td in the absence or presence of LAS for various D254 substituted lipase variants and their reference lipases are shown in table 4.

TABLE 4

| Mutations | Td (° C.) | Td(L) + 0.5 mM LAS (° C.) |
|---|---|---|
| N33Q + T231R + N233R | 75.2 | 68.8 |
| N33Q + T231R + N233R + D254S | 76.3 | 79.3 |
| N33Q + T231R + N233R + D254T | 71.3 | 71.9 |
| N33Q + T231R + N233R + D254N | 72.6 | 72.9 |
| N33Q + T231R + N233R + D254Y | 69.6 | 68.4 |
| N33Q + T231R + N233R + D254H | 69.4 | 68.3 |
| N33Q + T231R + N233R + D254L | 69.7 | 67.5 |
| N33Q + T231R + N233R + D254Q | 71.4 | 68.9 |

Example 5

Thermo Stability

The thermo stability was determined as described in example 1. The thermal denaturation temperature, Td in the absence or presence of LAS and $CaCl_2$ for a D254S lipase variant is shown in table 5.

TABLE 5

| Mutations | Td (° C.) | Td(L) + 0.5 mM LAS (° C.) | Td (L + C) + 0.5 mM LAS + 1 mM CaCl2 (° C.) |
|---|---|---|---|
| T231R + N233R + D254S | 76.5 | 77.7 | 78.9 |

Example 6

Real Time Storage Stability Data

The storage stability was determined in detergent D001 as described in example 2a. The residual activity and the half life improvement factor (HIF) of the lipase variant and its reference lipase are shown in table 6.

TABLE 6

| Mutations | Residual activity (%) | STDEV (%) | HIF |
|---|---|---|---|
| — | 35 | 6 | 0.8 |
| T231R + N233R | 41 | 10 | 1.0 |
| T231R + N233R + D254S | 95 | 8 | 18.7 |
| N33Q + T231R + N233R | 36 | 0 | 0.9 |
| N33Q + T231R + N233R + D254S | 72 | 2 | 2.7 |

Example 7

Real Time Storage Stability Data

The storage stability was determined in detergent D001 as described in example 2a. The residual activity and the half life improvement factor (HIF) of the lipase variant and its reference lipase are shown in table 7.

TABLE 7

| Mutations | Residual activity (%) | STDEV (%) | HIF |
|---|---|---|---|
| T231R + N233R | 43 | 2 | 1.0 |
| N33Q + T231R + N233R | 32 | 2 | 0.7 |
| N33Q + T231R + N233R + D254S | 74 | 3 | 2.8 |

Example 8

Stability in Various Detergents

The storage stability was determined in detergents D001, D002 and D003 as described in example 2a. The half life in hours of the lipase variant and its reference lipase are shown in table 8.

TABLE 8

| Mutation | D001 | D002 | D003 |
|---|---|---|---|
| T231R + N233R | 255 | 1131 | 613 |
| T231R + N233R + D254S | 2478 | 3716 | 1323 |

Example 9

Stability in LAS Systems

The storage stability after 1, 2, 3, 4, 6, 24, and 48 hours were determined in replicates of four in the two LAS comprising compositions: X001 and X002 at pH 7 and pH 9, respectively as described in example 2b. The lipases were stable in the reference buffer X013 over the observed time period. The half life in hours of the lipase variant and its reference lipase are shown in table 9.

TABLE 9

| Mutation | X001 | X002 |
|---|---|---|
| T231R + N233R | 8.9 | 3.8 |
| T231R + N233R + D254S | 135.0 | 172.8 |
| N33Q + T231R + N233R + D254S | 136.0 | 251.2 |

Example 10

Real Time Storage Stability Data

The storage stability was determined as described in example 2c. The half life in weeks and the half life improvement factor (HIF) of the lipase variant and its reference lipase in detergent D001, D002, and D003 at various temperatures are shown in tables 10a, 10b, and 10c respectively.

TABLE 10a

| Mutation | 35° C. | 37° C. | 40° C. |
|---|---|---|---|
| T231R + N233R | 1.2 | 0.7 | 0.2 |
| T231R + N233R + D254S | 6.5 | 4.4 | 1.6 |
| HIF | 5.3 | 6.4 | 10.1 |

TABLE 10b

| Mutation | 35° C. | 37° C. | 40° C. |
|---|---|---|---|
| T231R + N233R | 6.2 | 5.8 | 3.2 |
| T231R + N233R + D254S | 13.2 | 16.7 | 12.3 |
| HIF | 2.1 | 2.9 | 3.8 |

TABLE 10c

| Mutation | 35° C. | 37° C. | 40° C. |
|---|---|---|---|
| T231R + N233R | 1.7 | 1.2 | 0.5 |
| T231R + N233R + D254S | 2.2 | 1.9 | 1.2 |
| HIF | 1.3 | 1.6 | 2.3 |

Example 11

Stability in Mixed Surfactant Systems

The storage stability after 19.25, 161.75 and 329.25 hours were determined in replicates of four in the detergent mixes containing different surfactants at different pH as listed in Table 11a. Tests were done as described in example 2b, but at the indicated storage temperatures. The lipases were stable in the reference buffer X013 over the tested time period. The half life in hours of the lipase variant and its reference lipase are shown in Table 11b. The improvement factor is shown as the ratio of the half life of the variant with the D254S mutation versus without.

TABLE 11a

| | X002 | X004 | X005 | X006 | X010 | X012 |
|---|---|---|---|---|---|---|
| Na-LAS (%) | 11.1 | 7.40 | 7.40 | 7.40 | 3.63 | 18.5 |
| SLES (%) | — | — | — | — | 3.63 | — |
| Soap* (%) | — | — | — | — | — | — |
| NI [Non-ionic] (%) | — | 3.63 | 3.63 | 3.63 | 3.63 | 9.2 |
| Tris (mM) | 22.2 | 22.2 | 22.2 | 22.2 | 22.2 | 22.2 |
| NaCl (mM) | 111 | 111 | 111 | 111 | 111 | 111 |
| Glycerol (%) | — | — | — | — | — | 5.55 |
| MPG (%) | — | — | — | — | — | — |
| EtOH (%) | — | — | — | — | — | — |
| Citrate (%) | — | — | — | — | — | — |
| DTPMP [Diethylenetriamine penta(methylene phosphonic acid) phosphonate builder system, Dequest 2066] (%) | — | — | — | — | — | — |
| pH | 9.0 | 7.0 | 8.0 | 9.0 | 9.0 | 9.0 |
| AI:NI ratio | 1:0 | 2:1 | 2:1 | 2:1 | 2:1 | 2:1 |
| Total of surfactant addition (Na-LAS + SLES + NI) (%) | 10 | 10 | 10 | 10 | 10 | 25 |

| | X015 | X016 | X017 | X018 | X019 | X020 | X021 |
|---|---|---|---|---|---|---|---|
| Na-LAS (%) | — | 7.40 | — | 27.8 | 1.11 | 4.44 | 7.40 |
| SLES (%) | — | — | 11.1 | — | 6.33 | — | — |
| Soap (%) | 7.40 | — | — | — | — | — | — |
| NI [Non-ionic] (%) | 3.63 | 3.63 | — | — | 3.63 | 6.66 | 3.63 |
| Tris (mM) | 22.2 | 22.2 | 22.2 | 22.2 | 22.2 | 22.2 | 22.2 |
| NaCl (mM) | 111 | 111 | 111 | 111 | 111 | 111 | 111 |
| Glycerol (%) | 5.55 | — | — | — | — | — | — |
| MPG (%) | — | 16.7 | — | 16.7 | — | — | — |

TABLE 11a-continued

| | | | | | | | |
|---|---|---|---|---|---|---|---|
| EtOH (%) | 2.22 | — | — | — | — | — | — |
| Citrate (%) | — | — | — | — | — | — | 1.67 |
| DTPMP [Diethylenetriamine penta(methylene phosphonic acid) phosphonate builder system, Dequest 2066] (%) | — | — | — | — | — | — | 1.67 |
| pH | 9.0 | 8.0 | 9.5 | 8.0 | 9.0 | 9.0 | 8.0 |
| AI:NI ratio | 2:1 | 2:1 | 1:0 | 1:0 | 2:1 | 2:3 | 2:1 |
| Total of surfactant addition (Na-LAS + SLES + NI) (%) | 10 | 10 | 10 | 25 | 10 | 10 | 10 |

TABLE 11b

| Detergent | X002 | X002 | X004 | X005 | X006 | X006 | X010 | X012 |
|---|---|---|---|---|---|---|---|---|
| Incubation temperature | 37 | 40 | 37 | 37 | 37 | 40 | 37 | 37 |
| T231R + N233R | 2.9 | 2.9 | 22.3 | 26.4 | 7.4 | 2.9 | 29.1 | 67.5 |
| T231R + N233R + D254S | 6.1 | 54.4 | 548.2 | 579.6 | 178.1 | 68.9 | 294.4 | 380.4 |
| Improvement factor | 2 | 19 | 25 | 22 | 24 | 24 | 10 | 6 |

| Detergent | X015 | X016 | X017 | X018 | X019 | X020 | X021 |
|---|---|---|---|---|---|---|---|
| Incubation temperature | 37 | 40 | 40 | 37 | 40 | 40 | 40 |
| T231R + N233R | 30.0 | 18.6 | 8.9 | 19.1 | 32.3 | 47.0 | 32.9 |
| T231R + N233R + D254S | 1250.0 | 655.6 | 514.0 | 255.9 | 927.8 | 1080.0 | 1445.3 |
| Improvement factor | 42 | 35 | 58 | 13 | 29 | 23 | 44 |

Example 12

Wash Performance of Lipases after Storage in Detergent D001

Purified lipase was diluted (50 mM $H_3BO_3$/NaOH, 1M NaCl pH 9) to a concentration of 6.0 mg/mL. 0.25 mg lipase was added to 5 g detergent D001 (Table 1), stirred for 30 minutes and sealed. Samples were stored at 37° C. (stressed) for 0 days, 7 days and 14 days and thereafter transferred to −18° C. (no stress).

After storage the wash performance was measured at laboratory scale using a method similar to ASTM D3050 (ASTM International, West Conshohocken, Pa.) with the modifications mentioned here. Soiled test swatches (CS-10: Cotton soiled with butter fat and colorant, Center For Testmaterials) were washed in a Terg-O-tometer at 90 rpm using 1 L detergent solution containing 5 g detergent D001 and 0 mg or 0.25 mg lipase. The swatches were washed at 30° C. using artificial water hardness with 15° dH $Ca^{++}$/$Mg^{++}$/$HCO3^{-}$ (ratio 4:1:7.5) for 15 minutes then rinsed under running tap water for 10 minutes. After washing and rinsing the swatches were dried at room temperature overnight. The cleanliness of the swatches was determined by light remission using a colorimeter measurement of 460 nm (Macbeth Colour Eye 7000 reflectance spectrophotometer) and the results were expressed as ΔR by subtracting the remission of the blank, which has been washed with detergent without enzyme.

TABLE 12

| Mutations | Storage time (Days) | ΔR | Standard Error | Residual activity (%) |
|---|---|---|---|---|
| T231R + N233R | 0 | 2.80 | 0.09 | 100 |
| | 7 | 2.10 | 0.15 | 75 |
| | 14 | 1.52 | 0.18 | 54 |
| T231R + N233R + D254S | 0 | 2.91 | 0.12 | 100 |
| | 7 | 2.73 | 0.14 | 94 |
| | 14 | 2.28 | 0.11 | 78 |

The invention described and claimed herein is not to be limited in scope by the specific aspects herein disclosed, since these aspects are intended as illustrations of several aspects of the invention. Any equivalent aspects are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

SEQUENCE LISTING

```
<160> NUMBER OF SEQ ID NOS: 2

<210> SEQ ID NO 1
<211> LENGTH: 918
<212> TYPE: DNA
<213> ORGANISM: Thermomyces lanuginosus
<220> FEATURE:
<221> NAME/KEY: CDS
<222> LOCATION: (1)..(873)
<220> FEATURE:
<221> NAME/KEY: sig_peptide
<222> LOCATION: (1)..(66)
<220> FEATURE:
<221> NAME/KEY: mat_peptide
<222> LOCATION: (67)..()
```

<400> SEQUENCE: 1

```
atg agg agc tcc ctt gtg ctg ttc ttt gtc tct gcg tgg acg gcc ttg       48
Met Arg Ser Ser Leu Val Leu Phe Phe Val Ser Ala Trp Thr Ala Leu
        -20                 -15                 -10

gcc agt cct att cgt cga gag gtc tcg cag gat ctg ttt aac cag ttc       96
Ala Ser Pro Ile Arg Arg Glu Val Ser Gln Asp Leu Phe Asn Gln Phe
    -5              -1  1               5                   10

aat ctc ttt gca cag tat tct gca gcc gca tac tgc gga aaa aac aat      144
Asn Leu Phe Ala Gln Tyr Ser Ala Ala Ala Tyr Cys Gly Lys Asn Asn
                15                  20                  25

gat gcc cca gct ggt aca aac att acg tgc acg gga aat gcc tgc ccc      192
Asp Ala Pro Ala Gly Thr Asn Ile Thr Cys Thr Gly Asn Ala Cys Pro
            30                  35                  40

gag gta gag aag gcg gat gca acg ttt ctc tac tcg ttt gaa gac tct      240
Glu Val Glu Lys Ala Asp Ala Thr Phe Leu Tyr Ser Phe Glu Asp Ser
        45                  50                  55

gga gtg ggc gat gtc acc ggc ttc ctt gct ctc gac aac acg aac aaa      288
Gly Val Gly Asp Val Thr Gly Phe Leu Ala Leu Asp Asn Thr Asn Lys
    60                  65                  70

ttg atc gtc ctc tct ttc cgt ggc tct cgt tcc ata gag aac tgg atc      336
Leu Ile Val Leu Ser Phe Arg Gly Ser Arg Ser Ile Glu Asn Trp Ile
75                  80                  85                  90

ggg aat ctt aac ttc gac ttg aaa gaa ata aat gac att tgc tcc ggc      384
Gly Asn Leu Asn Phe Asp Leu Lys Glu Ile Asn Asp Ile Cys Ser Gly
                95                  100                 105

tgc agg gga cat gac ggc ttc act tcg tcc tgg agg tct gta gcc gat      432
Cys Arg Gly His Asp Gly Phe Thr Ser Ser Trp Arg Ser Val Ala Asp
            110                 115                 120

acg tta agg cag aag gtg gag gat gct gtg agg gag cat ccc gac tat      480
Thr Leu Arg Gln Lys Val Glu Asp Ala Val Arg Glu His Pro Asp Tyr
        125                 130                 135

cgc gtg gtg ttt acc gga cat agc ttg ggt ggt gca ttg gca act gtt      528
Arg Val Val Phe Thr Gly His Ser Leu Gly Gly Ala Leu Ala Thr Val
    140                 145                 150

gcc gga gca gac ctg cgt gga aat ggg tat gat atc gac gtg ttt tca      576
Ala Gly Ala Asp Leu Arg Gly Asn Gly Tyr Asp Ile Asp Val Phe Ser
155                 160                 165                 170

tat ggc gcc ccc cga gtc gga aac agg gct ttt gca gaa ttc ctg acc      624
Tyr Gly Ala Pro Arg Val Gly Asn Arg Ala Phe Ala Glu Phe Leu Thr
                175                 180                 185

gta cag acc ggc gga aca ctc tac cgc att acc cac acc aat gat att      672
Val Gln Thr Gly Gly Thr Leu Tyr Arg Ile Thr His Thr Asn Asp Ile
            190                 195                 200

gtc cct aga ctc ccg ccg cgc gaa ttc ggt tac agc cat tct agc cca      720
Val Pro Arg Leu Pro Pro Arg Glu Phe Gly Tyr Ser His Ser Ser Pro
        205                 210                 215

gag tac tgg atc aaa tct gga acc ctt gtc ccc gtc acc cga aac gat      768
Glu Tyr Trp Ile Lys Ser Gly Thr Leu Val Pro Val Thr Arg Asn Asp
    220                 225                 230

atc gtg aag ata gaa ggc atc gat gcc acc ggc ggc aat aac cag cct      816
Ile Val Lys Ile Glu Gly Ile Asp Ala Thr Gly Gly Asn Asn Gln Pro
235                 240                 245                 250

aac att ccg gat atc cct gcg cac cta tgg tac ttc ggg tta att ggg      864
Asn Ile Pro Asp Ile Pro Ala His Leu Trp Tyr Phe Gly Leu Ile Gly
                255                 260                 265

aca tgt ctt tagtggccgg cgcggctggg tccgactcta gcgagctcga gatct        918
Thr Cys Leu
```

-continued

```
<210> SEQ ID NO 2
<211> LENGTH: 291
<212> TYPE: PRT
<213> ORGANISM: Thermomyces lanuginosus

<400> SEQUENCE: 2

Met Arg Ser Ser Leu Val Leu Phe Phe Val Ser Ala Trp Thr Ala Leu
        -20                 -15                 -10

Ala Ser Pro Ile Arg Arg Glu Val Ser Gln Asp Leu Phe Asn Gln Phe
    -5              -1  1               5                   10

Asn Leu Phe Ala Gln Tyr Ser Ala Ala Ala Tyr Cys Gly Lys Asn Asn
                15                  20                  25

Asp Ala Pro Ala Gly Thr Asn Ile Thr Cys Thr Gly Asn Ala Cys Pro
            30                  35                  40

Glu Val Glu Lys Ala Asp Ala Thr Phe Leu Tyr Ser Phe Glu Asp Ser
        45                  50                  55

Gly Val Gly Asp Val Thr Gly Phe Leu Ala Leu Asp Asn Thr Asn Lys
    60                  65                  70

Leu Ile Val Leu Ser Phe Arg Gly Ser Arg Ser Ile Glu Asn Trp Ile
75                  80                  85                  90

Gly Asn Leu Asn Phe Asp Leu Lys Glu Ile Asn Asp Ile Cys Ser Gly
                95                  100                 105

Cys Arg Gly His Asp Gly Phe Thr Ser Ser Trp Arg Ser Val Ala Asp
            110                 115                 120

Thr Leu Arg Gln Lys Val Glu Asp Ala Val Arg Glu His Pro Asp Tyr
        125                 130                 135

Arg Val Val Phe Thr Gly His Ser Leu Gly Gly Ala Leu Ala Thr Val
    140                 145                 150

Ala Gly Ala Asp Leu Arg Gly Asn Gly Tyr Asp Ile Asp Val Phe Ser
155                 160                 165                 170

Tyr Gly Ala Pro Arg Val Gly Asn Arg Ala Phe Ala Glu Phe Leu Thr
                175                 180                 185

Val Gln Thr Gly Gly Thr Leu Tyr Arg Ile Thr His Thr Asn Asp Ile
            190                 195                 200

Val Pro Arg Leu Pro Pro Arg Glu Phe Gly Tyr Ser His Ser Ser Pro
        205                 210                 215

Glu Tyr Trp Ile Lys Ser Gly Thr Leu Val Pro Val Thr Arg Asn Asp
    220                 225                 230

Ile Val Lys Ile Glu Gly Ile Asp Ala Thr Gly Gly Asn Asn Gln Pro
235                 240                 245                 250

Asn Ile Pro Asp Ile Pro Ala His Leu Trp Tyr Phe Gly Leu Ile Gly
                255                 260                 265

Thr Cys Leu
```

The invention claimed is:

1. A method of making a detergent composition comprising the following (a) a lipase variant of a parent lipase which variant has at least 90% sequence identity with the mature polypeptide of SEQ ID NO: 2, substitutions at positions corresponding to T231R+N233R+D254S or N33Q+T231R+N233R+D254S of the mature polypeptide of SEQ ID NO: 2, and has lipase activity, or a fragment thereof having lipase activity, and (b) an anionic surfactant selected from linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid, soap, or any combination thereof, wherein said composition has increased thermostability of the lipolytic activity of the lipase variant, as measured by differential scanning calorimetry, in comparison with the lipolytic activity of the parent lipase of SEQ ID NO: 2 in a corresponding composition comprising said anionic surfactant.

2. The method of claim 1, wherein the lipase variant has at least 95% sequence identity to the mature polypeptide of SEQ ID NO: 2.

3. The method of claim 1, wherein the composition further comprises $CaCl_2$.

4. The method of claim 1, wherein the lipase variant consists of the substitutions T231R+N233R+D254S or N33Q+T231R+N233R+D254S of the mature polypeptide of SEQ ID NO: 2.

5. The method of claim 1, wherein the lipase variant consists of the substitutions T231R+N233R+D254S of the mature polypeptide of SEQ ID NO: 2.

* * * * *